US009657974B2

(12) United States Patent
Emma

(10) Patent No.: US 9,657,974 B2
(45) **Date of Patent: *May 23, 2017**

(54) MULTIPLE LINKED APPLIANCE WITH AUXILIARY OUTLET

(71) Applicant: Intirion Corporation, Walpole, MA (US)

(72) Inventor: Phillip Emma, Topsfield, MA (US)

(73) Assignee: Intirion Corporation, Walpole, MA (US)

( * ) Notice: Subject to any disclaimer, the term of this patent is extended or adjusted under 35 U.S.C. 154(b) by 284 days.

This patent is subject to a terminal disclaimer.

(21) Appl. No.: 14/262,290

(22) Filed: Apr. 25, 2014

(65) Prior Publication Data

US 2014/0251982 A1 Sep. 11, 2014

Related U.S. Application Data

(63) Continuation-in-part of application No. 12/317,632, filed on Dec. 23, 2008, now Pat. No. 8,742,304.

(60) Provisional application No. 61/009,419, filed on Dec. 28, 2007.

(51) Int. Cl.

| | |
|---|---|
| ***H05B 6/64*** | (2006.01) |
| ***H05B 6/66*** | (2006.01) |
| ***H05B 6/68*** | (2006.01) |
| ***F25B 29/00*** | (2006.01) |

(52) U.S. Cl.
CPC ..... *F25B 29/00* (2013.01); *H05B 6/68* (2013.01)

(58) Field of Classification Search
CPC . H05B 6/68; H05B 6/808; H05B 6/66; H05B 6/645; F25B 29/00
USPC ..... 219/482, 483, 485, 488, 679, 695, 702, 219/716, 717, 718, 723, 720, 715, 678
See application file for complete search history.

(56) References Cited

U.S. PATENT DOCUMENTS

| | | | | |
|---|---|---|---|---|
| 4,763,015 | A * | 8/1988 | St. Louis | H02J 3/14 307/126 |
| 4,847,722 | A * | 7/1989 | Bennett | F25D 23/12 219/679 |
| 4,880,954 | A * | 11/1989 | Bennett | F25D 23/12 219/679 |
| 4,958,055 | A * | 9/1990 | Shim | F25D 23/12 219/679 |
| 5,521,359 | A * | 5/1996 | Bone | H05B 6/68 219/718 |
| 6,313,450 | B1 * | 11/2001 | Han | H05B 6/666 219/702 |
| 2004/0060932 | A1 * | 4/2004 | Chun | H05B 6/6435 219/714 |
| 2007/0262646 | A1 * | 11/2007 | Lee | H01R 13/6666 307/39 |

FOREIGN PATENT DOCUMENTS

JP 2001-33043 A * 2/2001

* cited by examiner

*Primary Examiner* — Hung D Nguyen
(74) *Attorney, Agent, or Firm* — Ralph E. Jocke; Walker & Jocke

(57) ABSTRACT

A combination microwave and refrigerator system is constructed having a single plug input supply. The microwave oven is adapted to provide power to a refrigerator, and to auxiliary receptacles adapted for low power operation. The current to the low power receptacles and the refrigerator is controlled by the controller for the microwave oven according to the duty cycles of the connected appliances to avoid overload conditions.

22 Claims, 20 Drawing Sheets

MULTIPLE LINKED APPLIANCE WITH AUXILIARY OUTLET

CROSS-REFERENCE TO RELATED APPLICATIONS

This application is a continuation-in-part of U.S. application Ser. No. 12/317,632 filed on Dec. 23, 2008, which claims benefit under 35 U.S.C. § 119(e) of Provisional Application No. 61/009,419, filed Dec. 28, 2007, the disclosure of which is incorporated herein by reference in its entirety.

FIELD OF THE INVENTION

This application relates to a system of multiple linked appliances connected to a power supply through a single supply cord. In particular a refrigerator and microwave are connected for single plug operation while providing additional special purpose outlets.

BRIEF DESCRIPTION OF RELATED DEVELOPMENTS

Combination refrigerator and microwave oven systems are described in U.S. Pat. Nos. 4,880,954 and 4,847,722. In the devices described, the refrigerator is connected to the power supply and provides a connection for the microwave oven to be connected to the same supply. A single plug, therefore, serves to connect both appliances and the current required for each appliance is supplied by the same supply cord and circuit.

To make this combination attractive for use in dorm rooms, hotel rooms, recreational vehicles, tractor trailer cabs, and other similar locations, it is necessary to provide some means by which the peak currents of both appliances are not demanded from the supply at the same time. Many household circuits are protected from overload conditions by means of an automatic circuit breaker that is activated when current in the circuit exceeds the breaker rating. This is 15 amps in many circuits.

The duty cycle of a refrigerator used in these combined systems includes a current spike that occurs during the first few seconds of operation. This is the start up current for the refrigerator compressor and is considerably reduced, as the compressor obtains its operational speed. In typical refrigerator appliances the peak current may be in the range of 7 to 9 amps, while the steady state current may level off at 1.4 amps or less. A microwave oven demands a relatively steady 8 to 13 amps. It is apparent that an overload condition will occur frequently, when both appliances are in use, unless some control is exercised.

In the '954 patent the compressor power is disabled when the microwave is energized. This is accomplished by coupling the timer of the microwave to the compressor power. In addition a door interlock enables the compressor, since the microwave is disabled when the door is open. The '722 patent describes a control circuit for a combination microwave and refrigerator system in which a relay disables the microwave oven for a period of time depending on the rating of the compressor, when the compressor of the refrigerator is energized.

It would be advantageous to construct a combination microwave/refrigerator system that also provides auxiliary outlets for low power applications, such as for the purpose of recharging cellular phones, operating lap top computers and other low power devices, while controlling the operation of the appliances to avoid overload conditions.

SUMMARY OF THE INVENTION

In an embodiment of this invention, a combination microwave and refrigerator system is constructed having a single plug input supply. The microwave oven is adapted to provide power to a refrigerator, and to auxiliary receptacles adapted for low power operation. The microwave oven includes a microprocessor controller adapted to monitor operation of the refrigerator compressor and controls the power to the microwave magnetron and other components. The current to the low power receptacles are separately monitored for control by the microwave controller. The microwave controller is adapted to balance the duty cycles of the connected appliances attached to avoid overload conditions. A control algorithm is implemented internally within the microwave controller. A receptacle for the refrigerator and the low power auxiliary receptacle may be implemented as part of the microwave control panel.

In one embodiment, the auxiliary outlets are constructed to provide low power for the purpose of recharging cellular phones, personal media devices, digital cameras, in addition to operating lap top computers and other low power devices. The current to the auxiliary outlets is sensed and provided to the microwave controller.

In another embodiment, the power to the auxiliary outlets is disabled by the microwave controller when the microwave magnetron is energized or whenever the current to the auxiliary outlets exceeds a preset value.

In one embodiment, a control model is established and executed by the microwave controller. The model is dependent on the state of operation of the microwave magnetron. As part of the control model, the power to the compressor is monitored to sense operation of the compressor. When power to the microwave is demanded, the compressor is disabled for a preset minimum period. When microwave demand ceases, refrigerator power is restored provided, that the preset minimum period has expired.

In another embodiment of the control module, sensing circuits are connected to monitor current to the auxiliary outlets. The control model is adapted to disable the power to the auxiliary receptacles, if the microwave is in operation. In addition the auxiliary receptacles are disabled if a predetermined maximum current is sensed. Another control model is based on operation of the refrigerator and operates to disable the auxiliary receptacles when the compressor is in the start-up mode.

In one aspect of the invention, a non-transitory processor storage readable medium having processor readable program code embodied therein for operating a control processor to control a system of multiple linked appliances having a microwave oven, a refrigerator, and an auxiliary power supply outlet is provided. The processor readable program code causes the control processor to disable the refrigerator and the auxiliary power supply outlet, when the microwave demands power, and enable the auxiliary power supply outlet when the microwave is off.

BRIEF DESCRIPTION OF THE DRAWINGS

The system of this invention is explained in more detail below with reference to the accompanying drawing, in which.

DESCRIPTION OF THE PREFERRED EMBODIMENT

Figure 1:
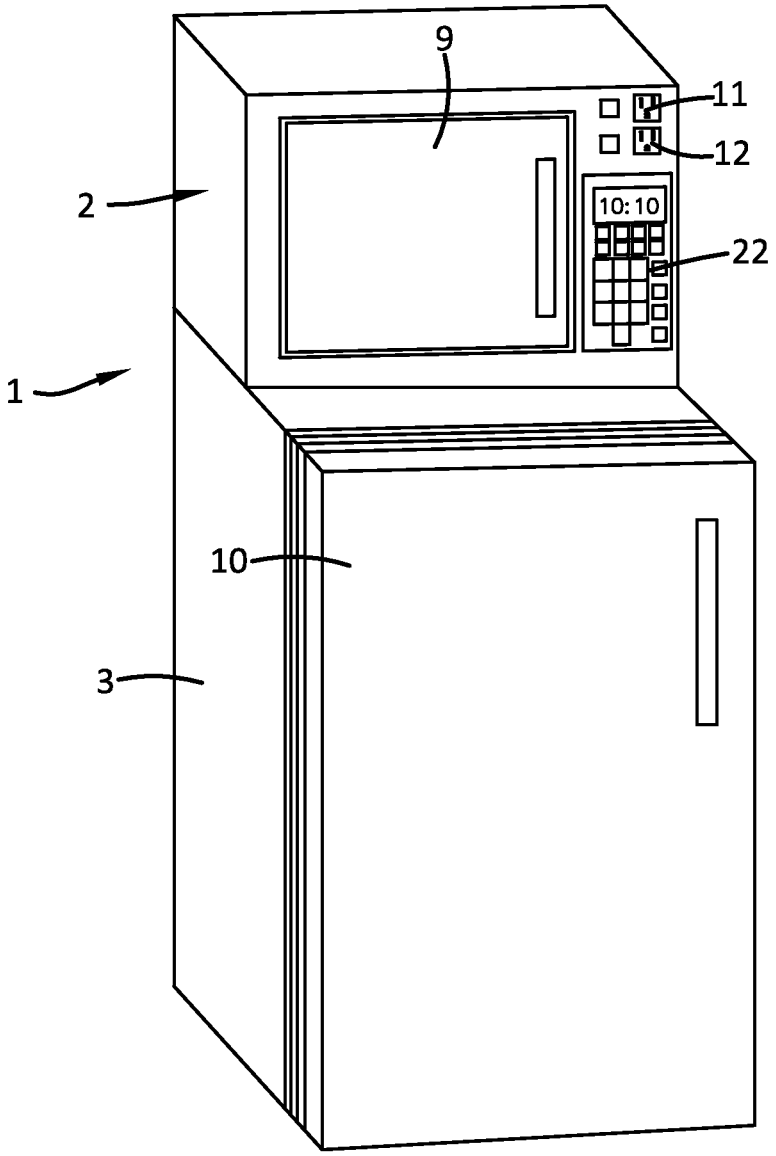
FIG. 1 is a front perspective view of an embodiment of an appliance system of this application.

A multiple linked appliance system 1, for example, a combination microwave oven 2, a refrigerator 3 incorporating features of the present invention is illustrated in the figures. Although the present invention will be described with reference to the embodiments shown in the drawings, it should be understood that the present invention may have many alternate forms. In addition, any suitable size, shape or type of elements or materials could be used. The computer operated devices described in this application may be constructed having one or several processors and one or several program product modules stored in one or several memory elements. For illustration, computer components may be described as individual units by function. It should be understood, that in some instances, these functional components may be combined.

Figure 2:
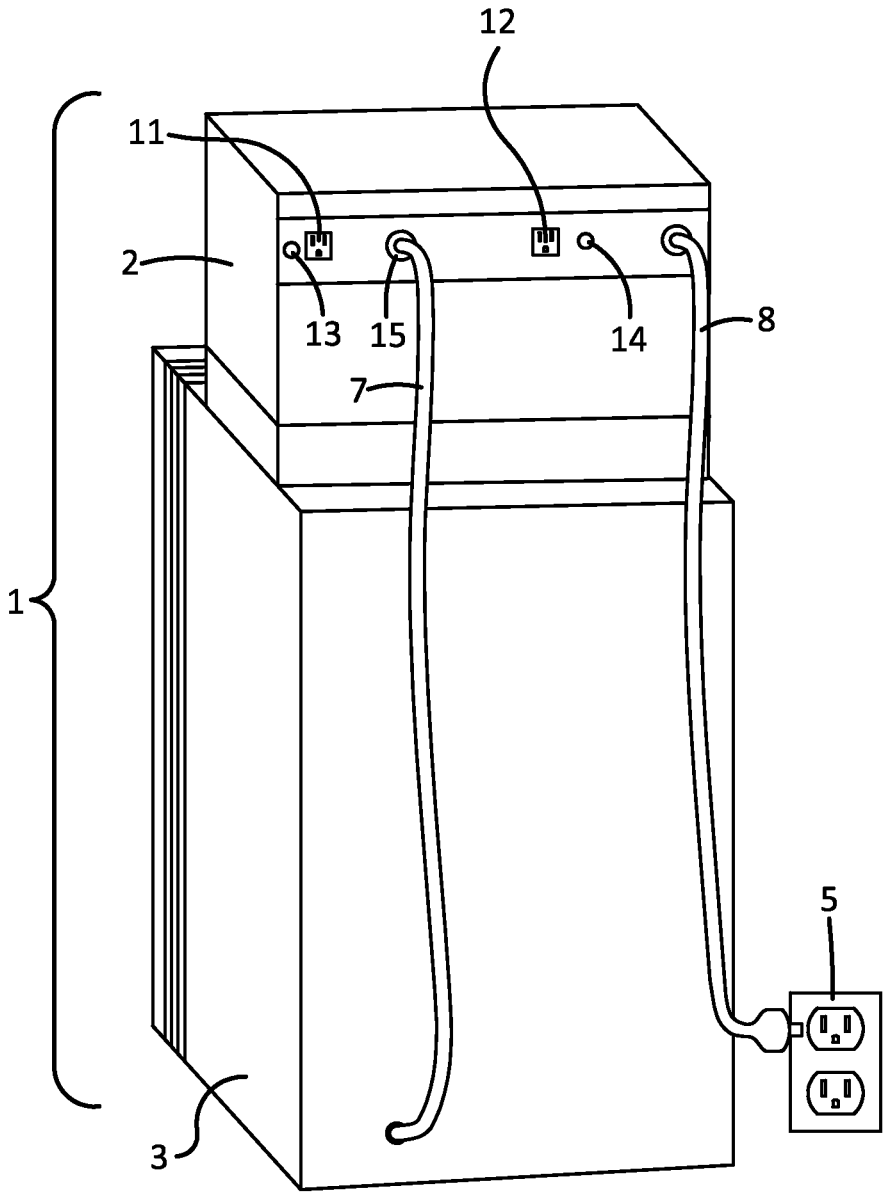
FIG. 2 is a rear perspective view of the embodiment of FIG. 1 showing an alternative arrangement.

One embodiment of a multi-appliance interconnected system 1 is illustrated in FIG. 1. This embodiment consists of two stand alone appliances, a refrigerator 3 and a microwave oven 2. Refrigerator 3 is connected to microwave oven 2 by power cord 7 to refrigerator receptacle 15, shown at the rear of the microwave 2 in FIG. 2. Refrigerator 3 is generally subject to control by the microwave microprocessor controller 4 of the microwave oven 2. A single cord 8 provides input power to the system 1 from receptacle 5 through microwave 2. In the case where stand alone appliances are used, as shown in FIGS. 1 and 2, microwave oven 2 is connected directly to power source 5. The refrigerator 3, as the heaviest component, is used as the base with the microwave oven 2 stacked on top. In the selection of the refrigerator 3, it would be advantageous in one embodiment for the height of the refrigerator to be no more than 48 inches above the floor. This provides a more ergonomic operation of the microwave oven 2 for the user. In addition, in the stacked position of the appliances in an embodiment, the doors 9 and 10 of the microwave 2 and refrigerator 3, respectively, should be arranged in a common plane. The appliances may be of standard design with features commonly available. The internal components of the appliances are well known and do not need to be described herein.

Figure 3:
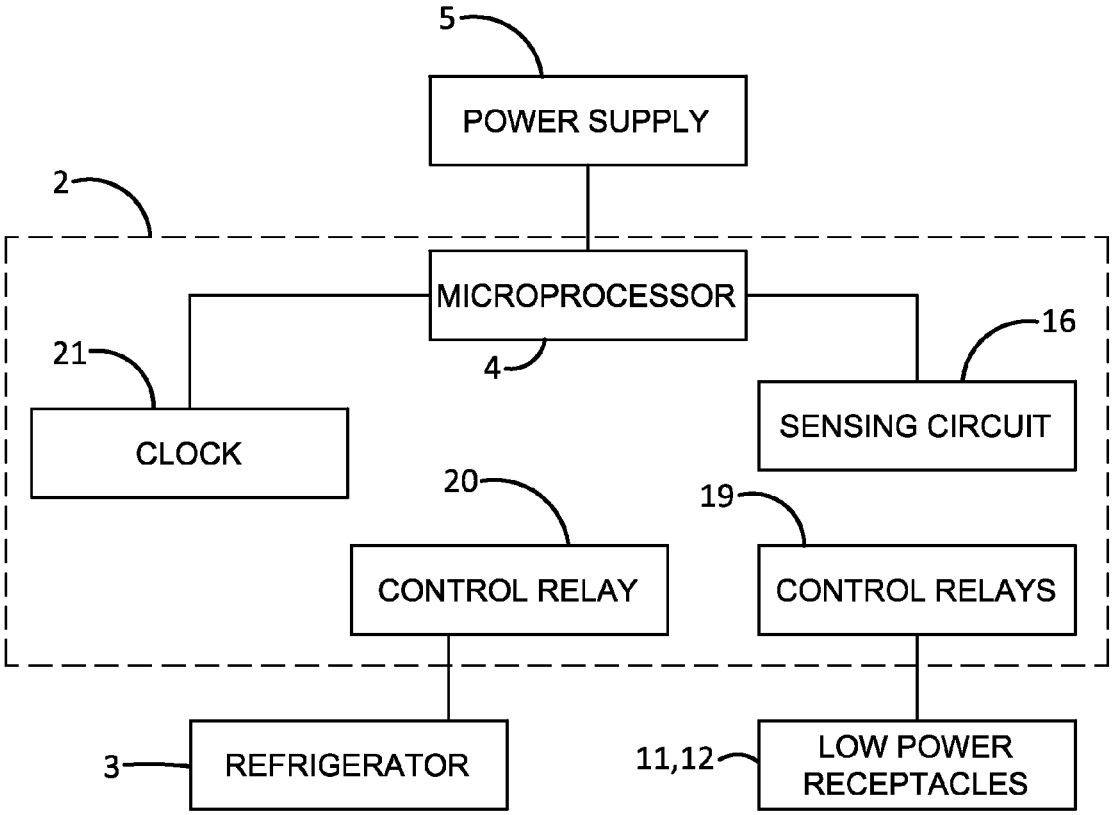
FIG. 3 is a block diagram of an embodiment of the system of this application.
Figure 8:
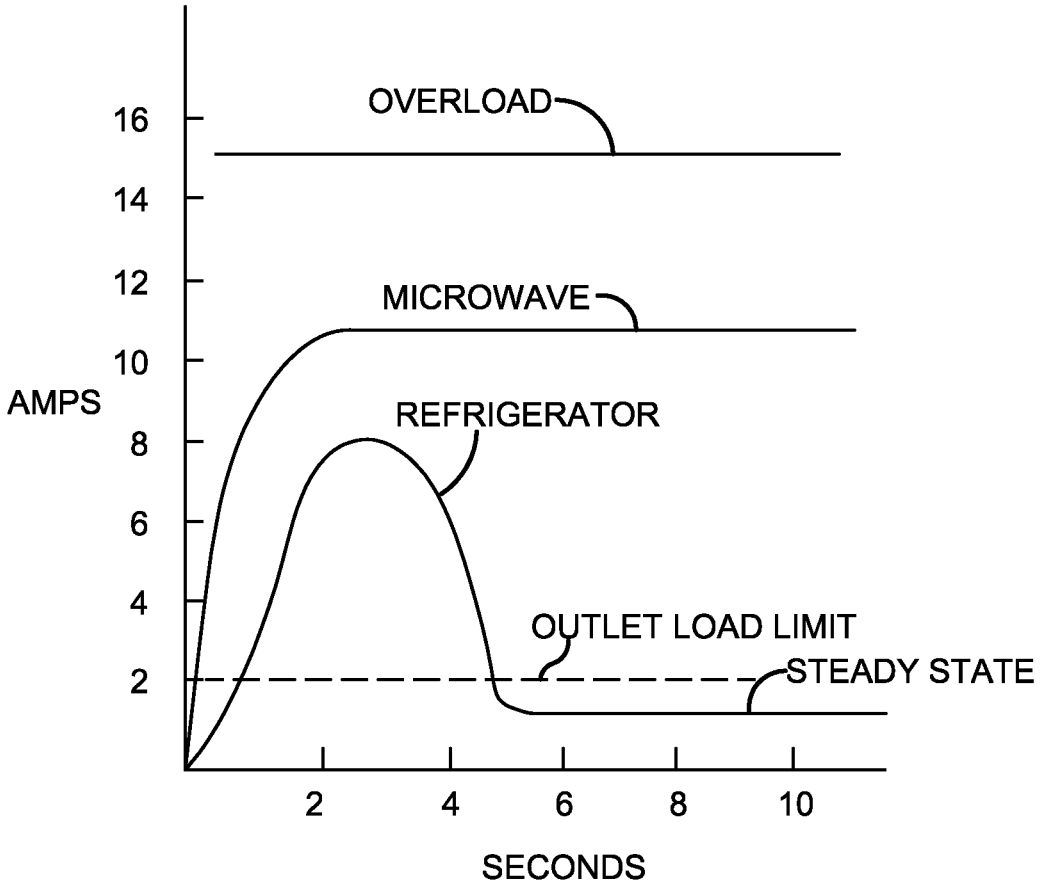
FIG. 8 is a graph illustrating the duty cycles of the appliances in the system of FIG. 3.

Microprocessor 4 is the controller for the operation of the microwave oven 2 and is also adapted to control the other components of system 1, as shown in FIG. 3. Power is distributed throughout the system 1 under control of microwave controller 4 and digitally operated switches such as relays 19 and 20 of FIG. 3. Power is distributed to each of the appliances 2 and 3, and to auxiliary low power receptacles 11 and 12. In use lamps 13 and 14 in the form of LED'S or the like may be connected to the auxiliary receptacles to indicate power being available or disabled. The low power auxiliary receptacles 11 and 12 are provided to permit convenient access for plugging in a low power device for example, rechargeable devices, such as cellular phones, PDA's, or other electronic devices that do not demand high power. As shown in the graph of FIG. 8, there are instances during which, if more than one of the appliances is in use, the cumulative current would cause an overload condition.

Control panel 22 of microwave oven 2 may be adapted to provide a display of the particular status of the controlling relays, for example, LED's 13 and 14 may indicate that power to the outlets 11, and 12 are disabled or available. In one embodiment the lamps will light when power is available at the outlet and flash when disabled. In another embodiment the lamps will light when power is disabled at the outlet and not activate when power is available at the outlet as a means to reduce the Standby Power requirements. A button operated touch panel provides manual control.

Figure 4:
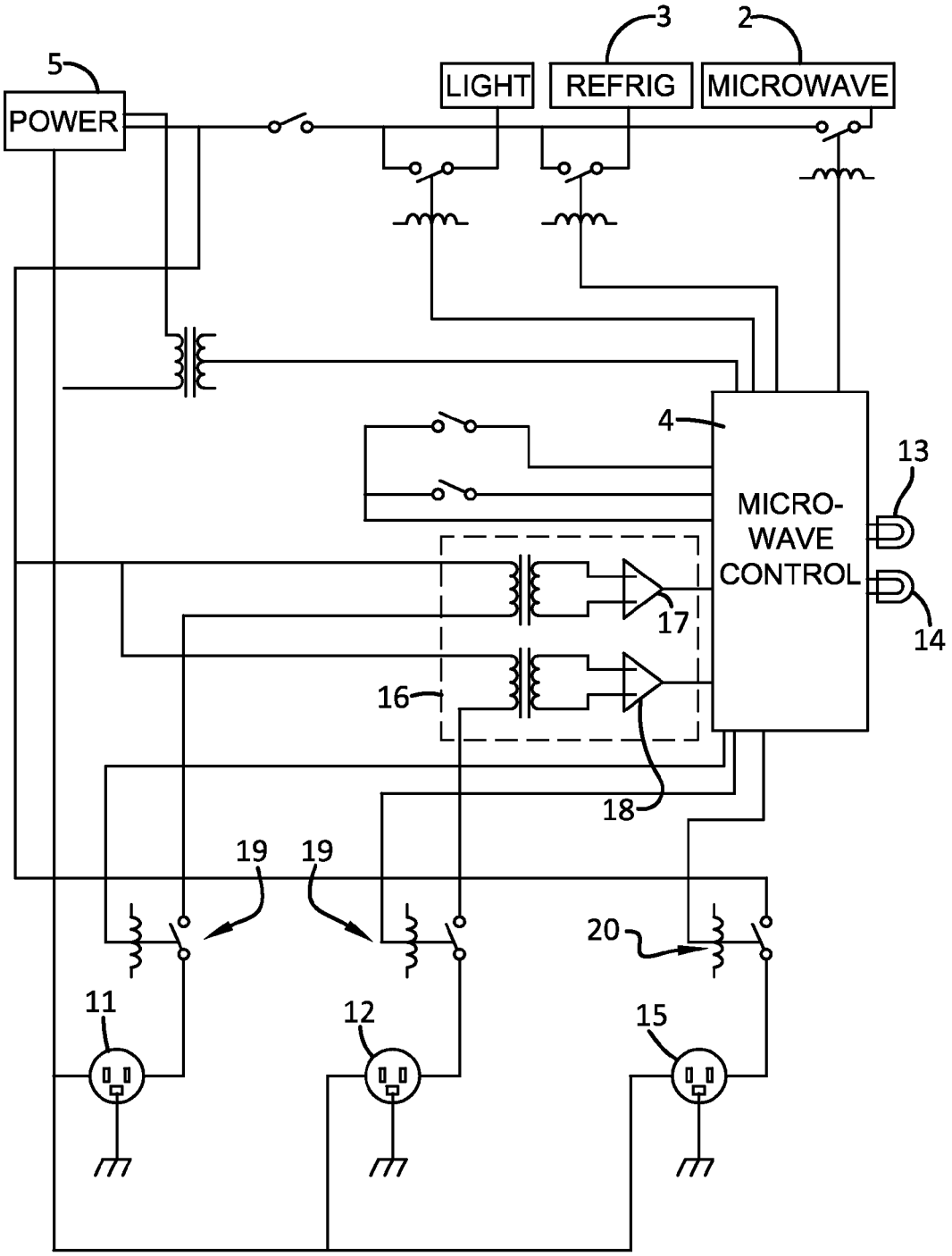
FIG. 4 is a schematic diagram of the embodiment of FIG. 3.

As shown in FIG. 4, in order to control the power to the microwave 2, refrigerator 3 and receptacles 11 and 12, sensing circuits, may be coupled to the controller to monitor current to the appliances and the auxiliary receptacles. A relay 20 is connected in the power line to the refrigerator and may be actuated by signals from controller 4. In particular, according to an embodiment of this application, sensing circuits 16, as shown in FIG. 4, have sensors 17 and 18 coupled to the power line of the auxiliary outlets 11 and 12 to monitor the current being used by a connected device. Sensors 17 and 18 may be current sensing transformers of the type available from Triad Magnetics of Corona, Calif. The signals generated by sensors 17 and 18 may be used to activate switches or other control components, such as relays 19. Relays 19 may be actuated by controller 4 to enable and disable power to the low power auxiliary outlets 11 and 12 in response to signals from sensors 17 and 18. A maximum current may be set by controller 4 to prevent overload of the outlets 11 and 12. In one embodiment of the system of this application, the maximum current limit is set at 2 amps.

In another embodiment, a clock device 21 could be used to provide timed delays during which, for example, refrigerator 3 would be prevented from undesirably rapid on/off cycles. When refrigerator 3 is disabled during microwave operation, a time delay of 3 minutes is provided during which refrigerator 3 will remain disabled, even if microwave use is only for a short period. Controller 4 may be programmed to manage the power to the components of the system to avoid overload conditions, while minimizing disruptions in the use of an individual appliance. A model of operative events and related control operations may be designed into the program executed by controller 4 to provide a control methodology as illustrated in FIGS. 5-7.

In one embodiment, as illustrated in the block diagram of FIG. 3, microprocessor controller 4, constructed as part of the controller for microwave 2, would be adapted to process the sensor signals and identify particular events in the system 1 related to a particular appliance. Microprocessor 4 would control the power to microwave 2 and refrigerator 3 and also low power receptacles 11 and 12 to avoid overload conditions. The microprocessor 4 could be programmed to execute the control methods illustrated and described below. In a preferred embodiment, the controller 4 is the control microprocessor for microwave oven 2 and is adapted to execute the control algorithms described below. Controller 4 is coupled directly to refrigerator outlet 15 and low power outlets 11 and 12.

In one embodiment, shown in FIG. 1, the outlets 11, and 12, are installed as part of the front control panel of microwave oven 2. In FIG. 2, in another embodiment, the auxiliary receptacles 11 and 12 and refrigerator receptacle 15 are accessible at the rear of the microwave oven 2. In these alternative embodiments, the microwave oven 2 is connected by supply cord 8 directly to power supply receptacle 5. Refrigerator 3 is connected by power cord 7 to receptacle 15 in microwave oven 2 as shown in FIG. 2.

Figure 5:
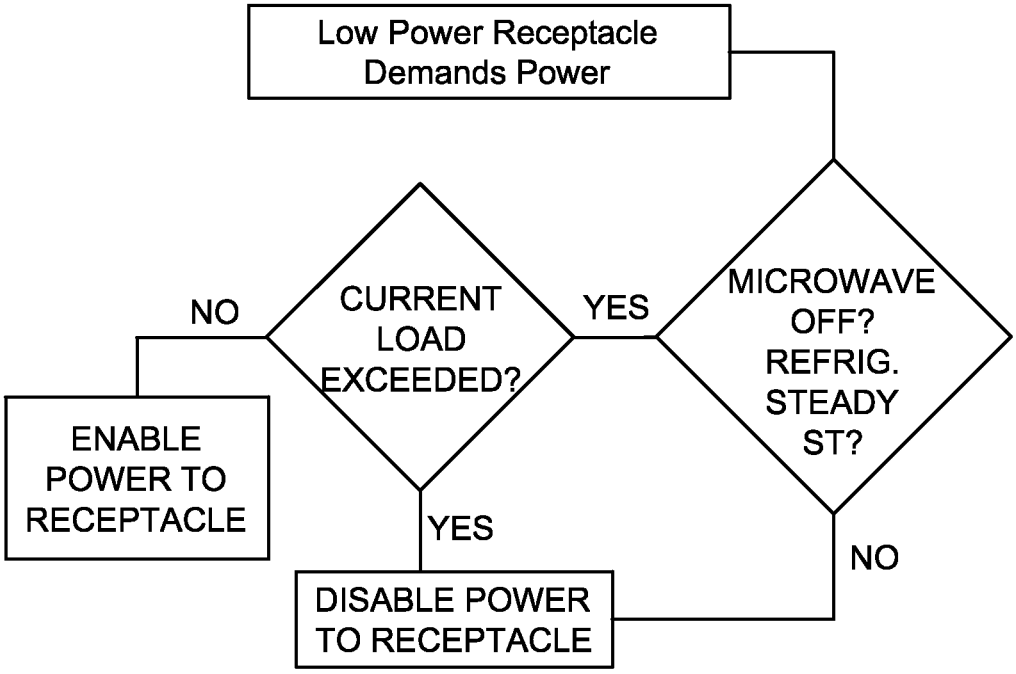
FIG. 5 is a flow diagram of an embodiment of this application.
Figure 6:
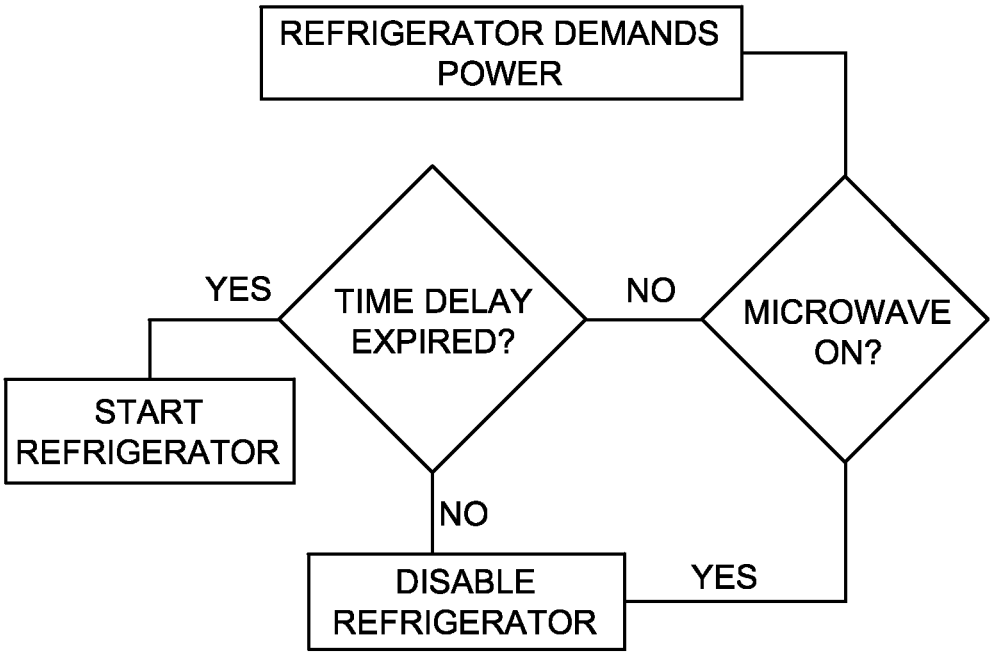
FIG. 6 is a flow diagram of another embodiment of this application.
Figure 7:
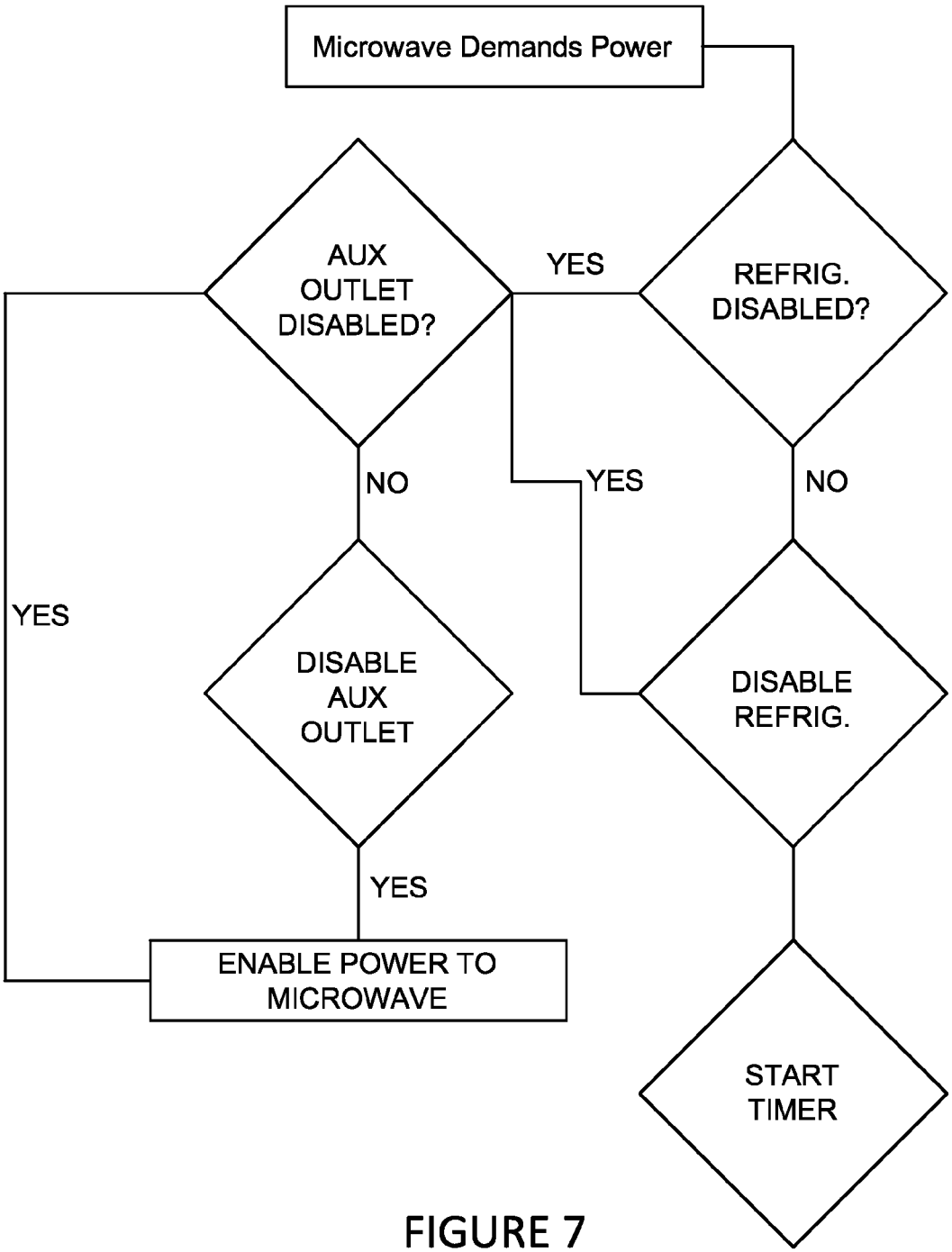
FIG. 7 is a flow diagram of another embodiment of this application.

In one embodiment, control models are established as shown in FIGS. 5-7 for execution by the controller 4. These models can be in the form of algorithms stored in a computer readable medium, such as software or firmware within microprocessor 4. The models shown are, in the first instance, dependent on the state of operation of microwave oven 2. The current demands of the microwave 2 are generally the most significant contribution to overload, as shown in FIG. 8. To avoid overload conditions, power to the low power receptacles 11 and 12 and refrigerator receptacle 15 is disabled during microwave operation. If the refrigerator 3 is under power when the microwave 2 is turned on, the power, to the refrigerator is turned off and clock 21 begins to count for a predetermined period during which the compressor of refrigerator 3 cannot be restarted. A time delay, for example, of 3 minutes, may be set and when this delay period is expired, receptacle 15 may again be enabled, providing microwave operation has ceased. This prevents a too rapid restart of the compressor that may otherwise result in damage.

In the embodiment shown in FIG. 5, if low power is demanded at receptacle 11 or 12 and microwave oven 2 is not in use, power is supplied to the low power receptacles, providing further, that the current demand in an individual outlet does not exceed a preset limit, for example, 2 amps. Since the auxiliary outlets may be enabled during refrigerator operation, there may be an overload generated at peak compressor operation. In one embodiment the microwave controller acts to disable the auxiliary outlets during compressor startup to prevent accidental overload of the system. Therefore as illustrated in the flow diagram of FIG. 5, controller may be adapted to check the operational status of the refrigerator, as well as the microwave oven, prior to enabling the auxiliary outlets.

Figure 9:
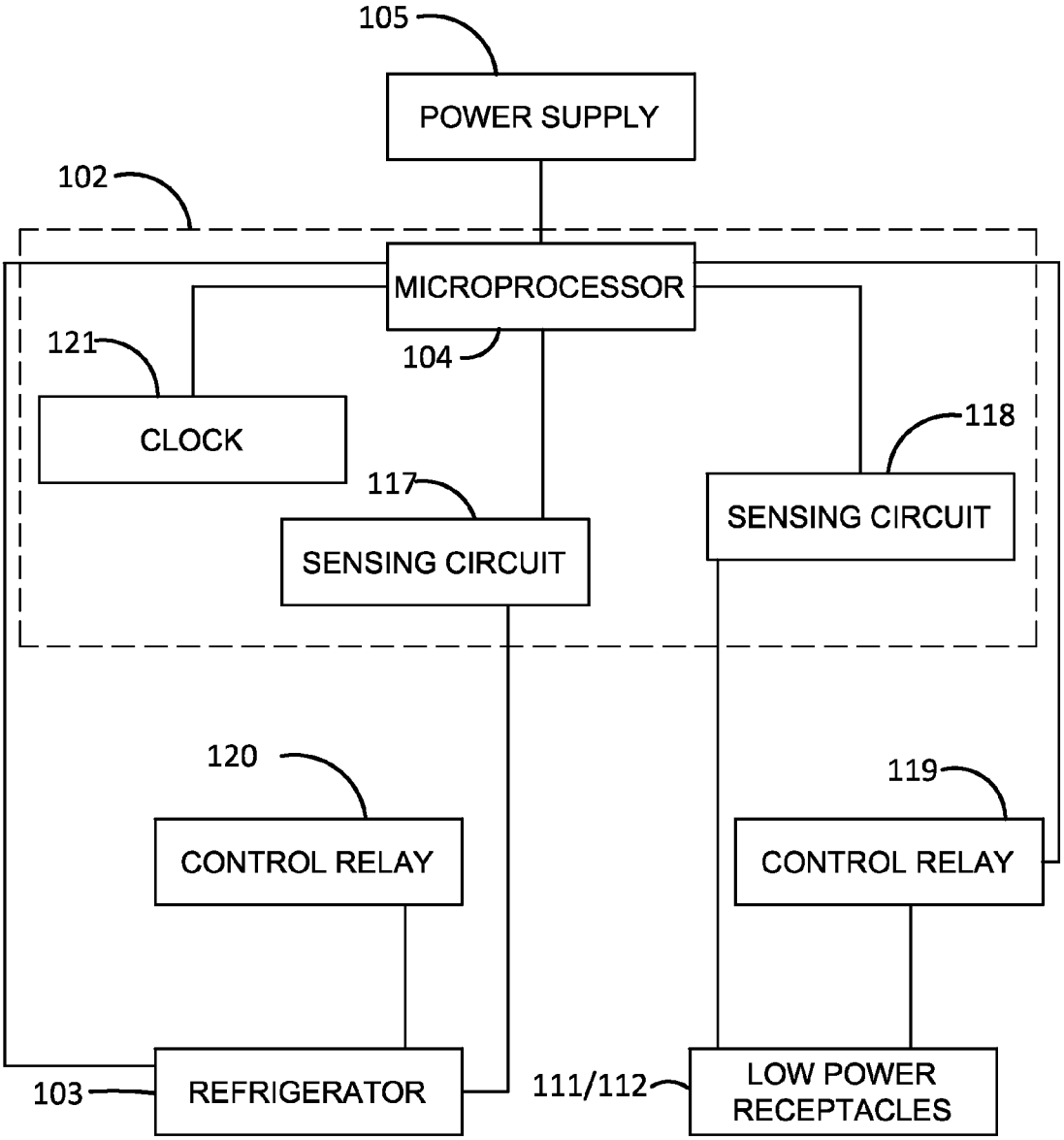
FIG. 9 is a block diagram of an alternate embodiment of this application.
Figure 10:
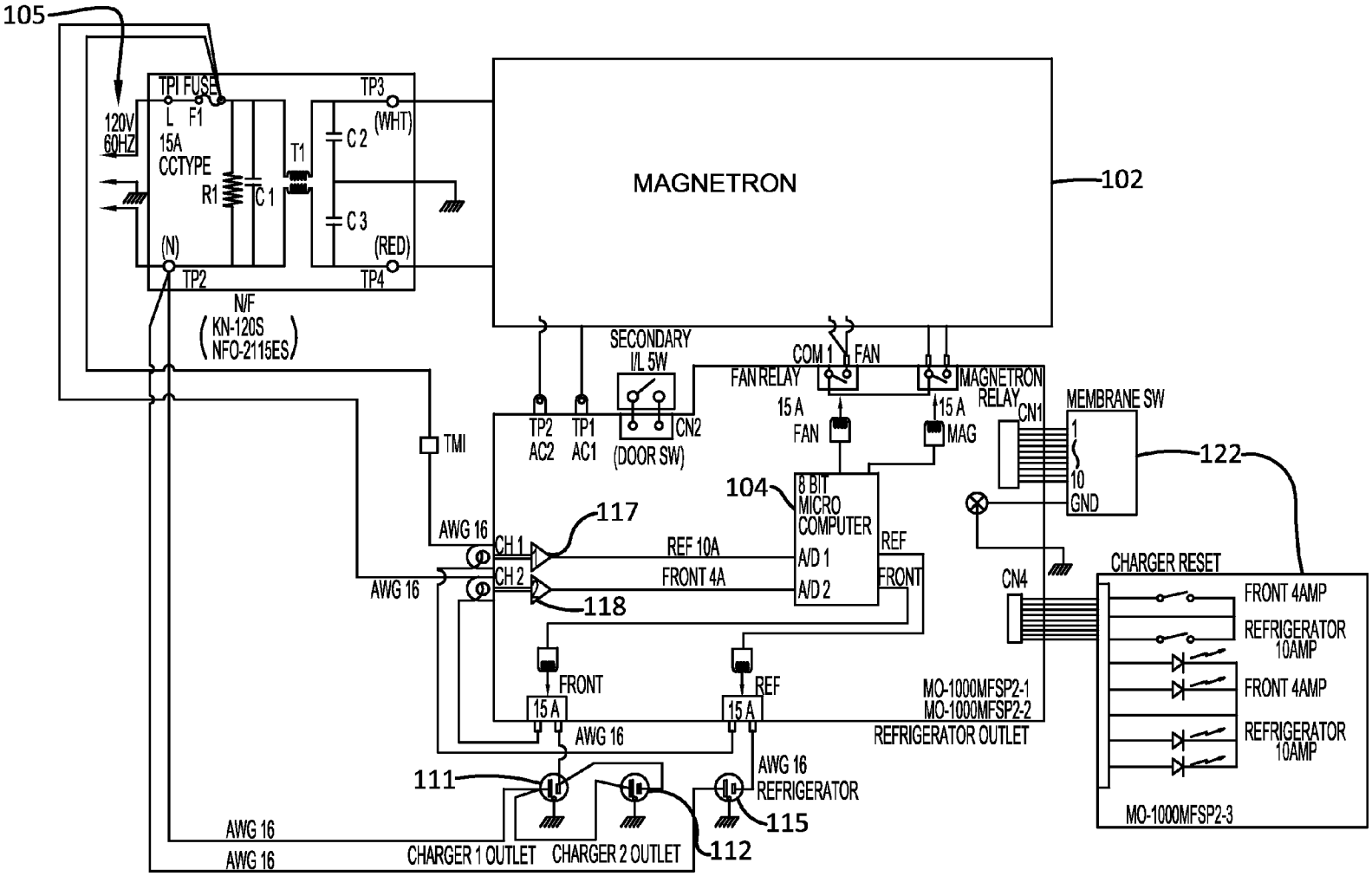
FIG. 10 is a schematic diagram of the embodiment of FIG. 9.
Figure 11:
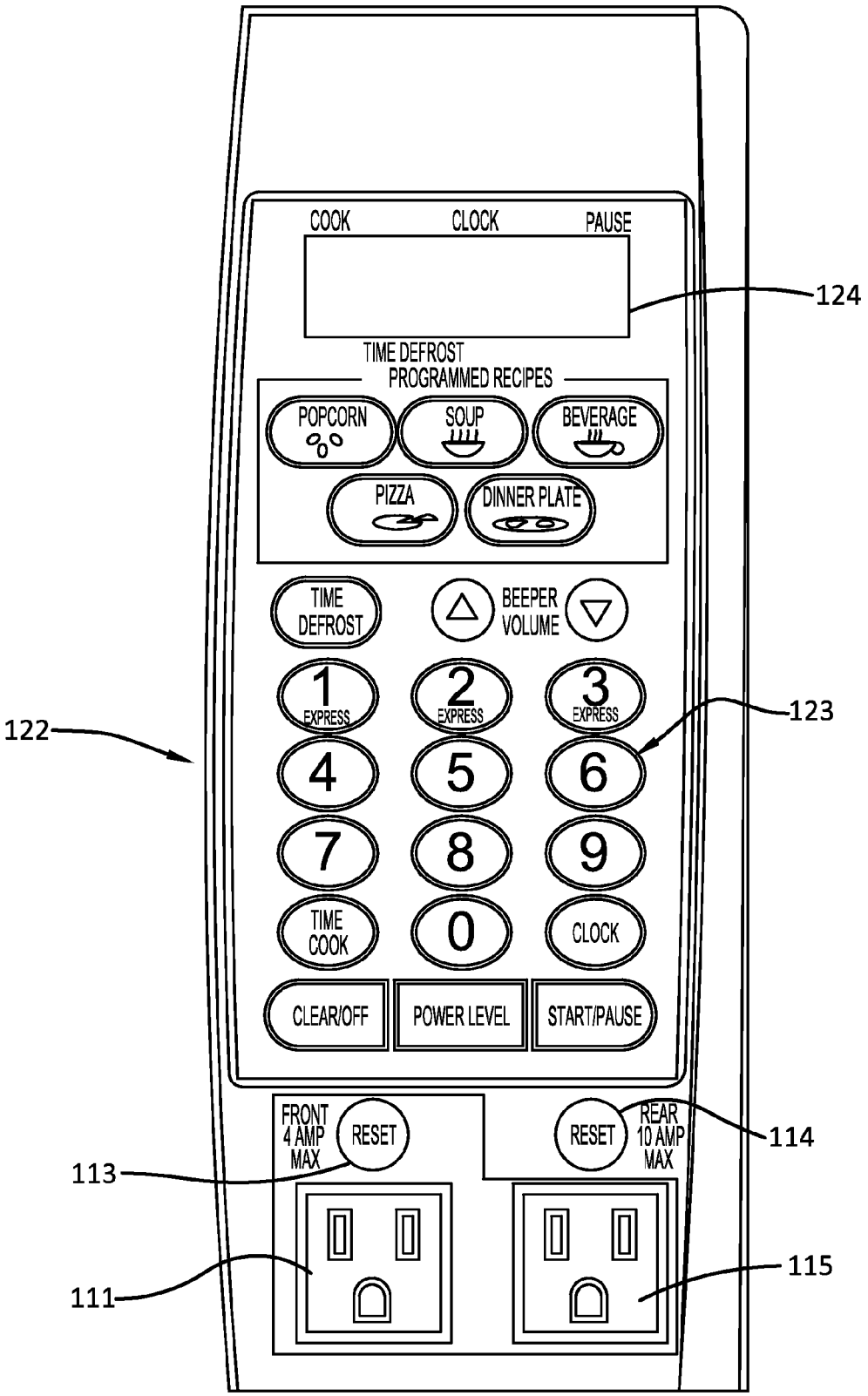
FIG. 11 is an illustration of a control panel of the embodiment of FIG. 9.

FIGS. 9-11 illustrate another embodiment. In this embodiment the sensing components 117 and 118 are connected to reduce the risk of overload by the combined demands of the auxiliary outlets 111 and 112 and the refrigerator outlet 115. In the configuration, as shown in FIG. 10, current sensor 117 is connected to monitor the current in the refrigerator outlet 115 and is constructed to limit the refrigerator current component so that it does not exceed 10 amps. Current sensor 118 is connected to monitor the combined current in the auxiliary outlets 111 and 112. Current sensor 118 is constructed to limit the combined auxiliary outlet current to 4 amps. In this manner the risk of overload is minimized In the block diagram of FIG. 9, the microwave 102 having controller 104 is connected to power supply 105. Clock 121 provides a timing device to generate a restart delay for refrigerator 103. Sensing circuit/sensor 117 is connected to monitor the current demanded by refrigerator 103 and sensing circuit/sensor 118 is connected to low power receptacles 111 and 112 to monitor the combined current in receptacle 111 and 112.

In this embodiment, as shown in FIG. 11, a control panel 122 is arranged with a keypad 123 for manual control and a display 124. Auxiliary outlet 111 is shown as accessible from the front and is associated with a status LED indicator and reset button 113 that may be caused to be on during use and switch to a flashing mode when the microwave is running Refrigerator outlet 115 is also shown to be accessible from the front panel and is associated with an LED indicator and reset button 114. Similarly LED indicator 114 is controlled to be on during use of the refrigerator and to switch to a flashing mode when the microwave is operating. In another embodiment, the status LED indicator and reset button 113 may be caused to be off during use and switched on or to a flashing mode when the microwave is running Similarly, in this another embodiment, the LED indicator 114 is controlled to be off during use of the refrigerator and switched on or to a flashing mode when the microwave is operating.

A further embodiment of the processor operational model is shown in FIG. 6. In this model, the refrigerator demands power. This may be triggered by a temperature drop in the refrigerator and involve start up of the refrigerator compressor with an associated peak power demand. If the microwave is on, the recycling of the refrigerator will be delayed. If the microwave was on and subsequently cycled off, the clock 21 must be checked to determine if the restart can occur. Under some circumstances, it may be necessary to give the refrigerator priority to prevent an undesirable drop in temperature. In the latter instance, microcontroller can be coupled to the refrigerator temperature sensor to execute a time sequence during which the microwave will be disabled to allow the refrigerator to return to proper operating temperatures.

In the embodiment of FIG. 7, priority is given to the power demands of the microwave oven, as indicated above. Use of the receptacles 11, 12, and 15 are, therefore, disabled during microwave operation. The operational models, illustrated in FIGS. 5-7, may be established by algorithms that are programmed or imbedded in controller 4.

In this manner a system of linked appliances, including a microwave oven, refrigerator, and a low power appliance may all be connected through a common supply cord without the risk of inconvenient interruptions in use caused by overloads.

Figure 13:
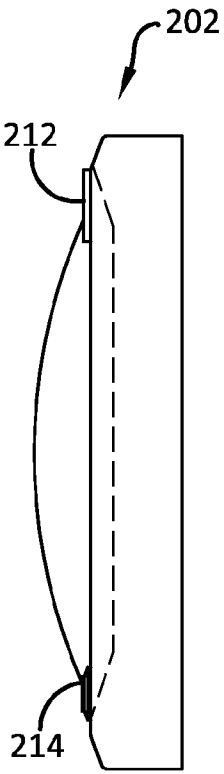
FIG. 13 is a side view of the microwave oven of FIG. 12
Figure 12:
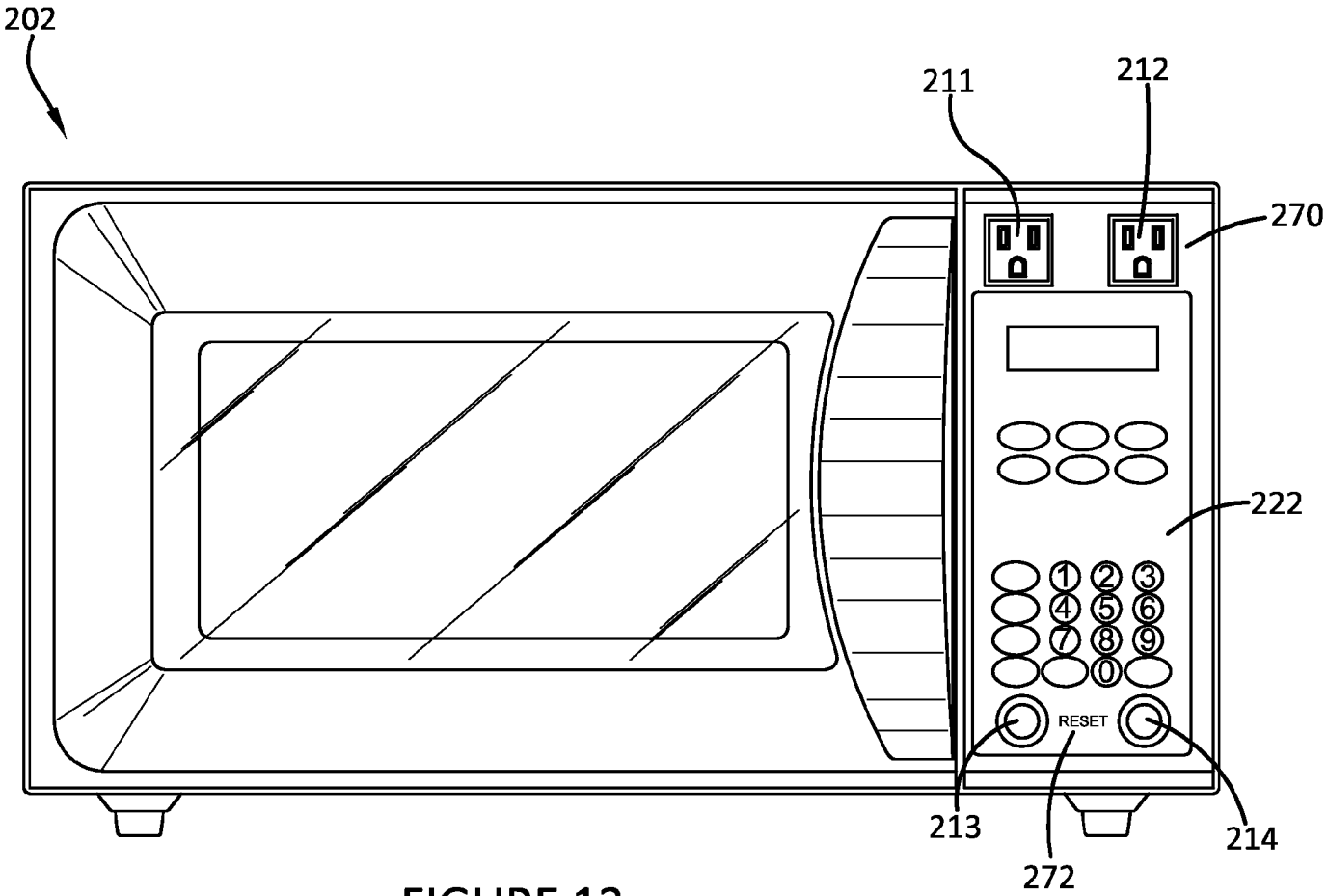
FIG. 12 is a front view of the microwave oven according to another embodiment of this application.

In another exemplary embodiment as illustrated in FIGS. 12 and 13, the auxiliary outlets or receptacles 211, 212 may be installed as part of the front control panel 222 of the microwave oven 202 and located on the upper portion 270 of the front control panel 222. The auxiliary outlets 211, 212, front control panel 222 and microwave oven 202 are similar to auxiliary outlets 11, 12, front control panel 22, and microwave oven 2 except for that discussed below. In this exemplary embodiment, the auxiliary outlets 211, 212 are positioned side by side with respect to each other with each of the auxiliary outlets 211, 212 being at the same height as the other. The auxiliary outlet 211 of FIG. 12 may be associated with a status LED indicator and reset button 213, which is located on the lower portion 272 of the front control panel and in vertical alignment with the auxiliary outlet 211. The status LED indicator and reset button 213 may be caused to be on during use and switched to a flashing mode when the microwave oven 202 is running. The auxiliary outlet 212 of FIG. 12 may be associated with status LED and reset button 214, which is located on the lower portion of the front control panel and in vertical alignment with the auxiliary outlet 212. The status LED indicator and reset button 214 may be caused to be on during use and switched to a flashing mode when the microwave oven 202 is running. In another embodiment, the status LED indicator and reset button 213 may be caused to be off during use and switched on or to a flashing mode when the microwave oven is running Similarly, in this another embodiment, the status LED indicator and reset button 214 may be caused to be off during use and switched on or to a flashing mode when the microwave oven is running All other elements are similar in structure and function as that of the embodiments shown in FIGS. 1-11. Thus, the same reference numbers will be used in this exemplary embodiment to indicate elements that are similar in the embodiments shown in FIGS. 1-11.

Figure 14:
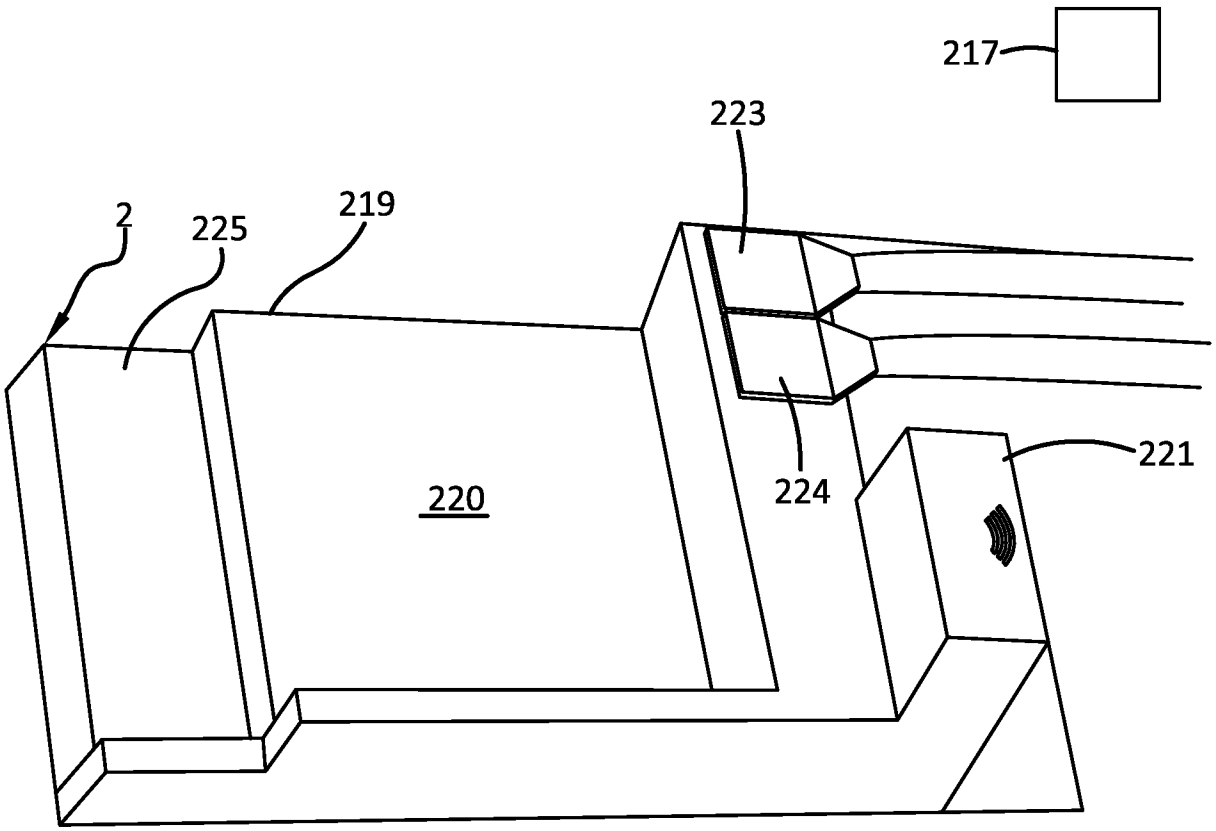
FIG. 14 is a top perspective view of a charging pad on the top portion of the microwave oven of this application.

Smart technology may be included in each of the exemplary embodiments. For example, a user may be able to regulate the refrigerator 3 such as by turning it on and off remotely by a remote device 217. The remote device 217 may be a hand held device such as a cellular phone. The cell phone may also be a smart phone. A charging pad 219 (FIG. 14) may be provided on the microwave oven 2 or other suitable place to receive the smart phone for charging the smart phone. For example, a wireless charging pad 219 may be placed on top 225 of the microwave oven 2 for recharging the smart phone. The charging pad 219 may be built into the top 225 of the microwave oven 2 or be a separate piece that is mounted to the top 225 of the microwave oven 2. The charging pad 219 includes a recessed area 220 for receiving an item to be charge such as the smart phone. The charging pad 219 may include a wireless connection 221 for the remote control device 217 for controlling the microwave or refrigerator such as turning off or on the microwave oven 2 and/or refrigerator 3. USB ports 223, 224 may be provided in the charging pad 219. Alternatively, or in addition, power outlets may be provided in the charging pad 219. Alternatively, the charging pad 219 may be provided on the front, side, rear or bottom of the microwave oven 2.

Figure 16:
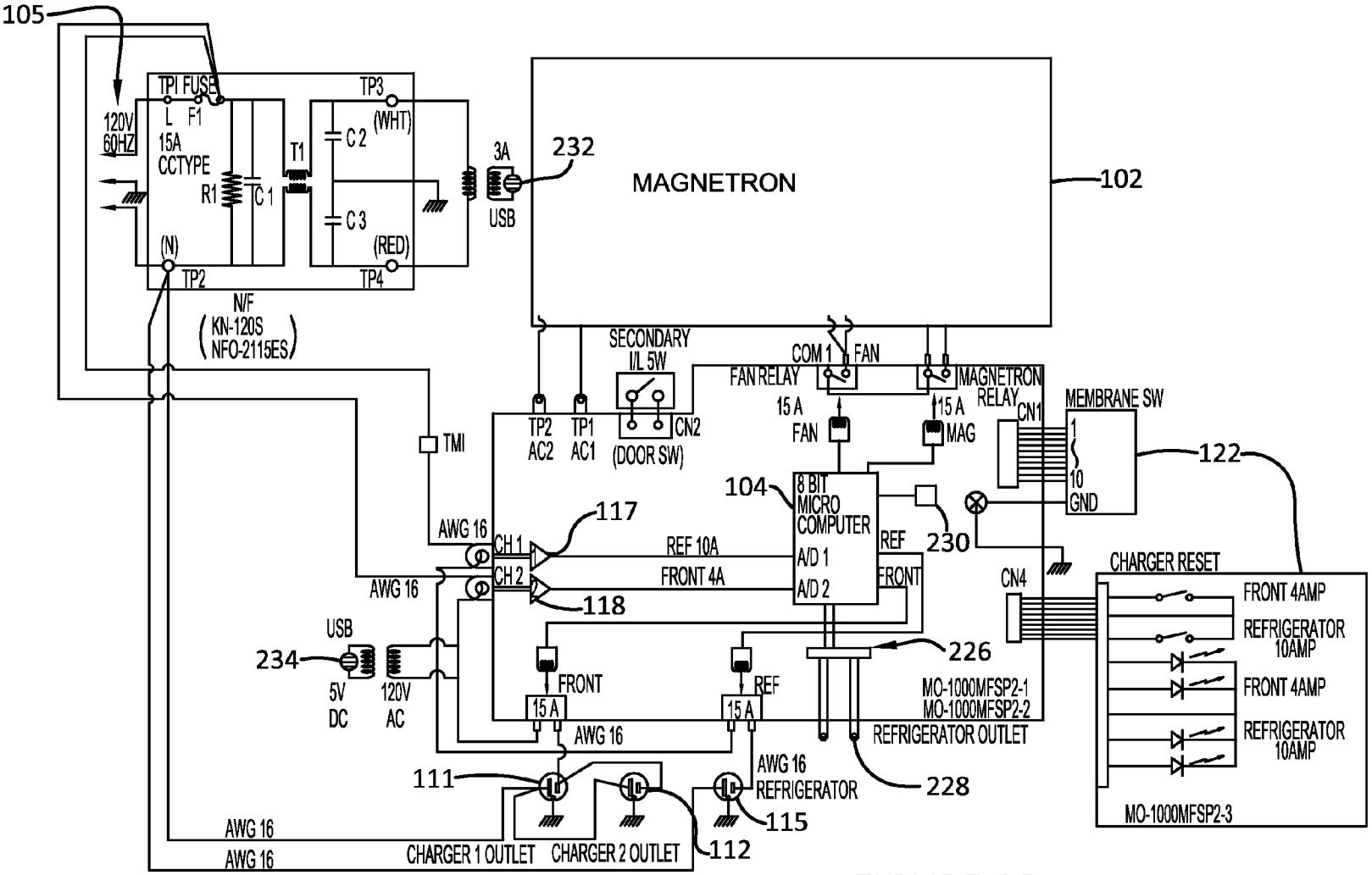
FIG. 16 is a schematic diagram of the embodiment of FIG. 15.
Figure 18:
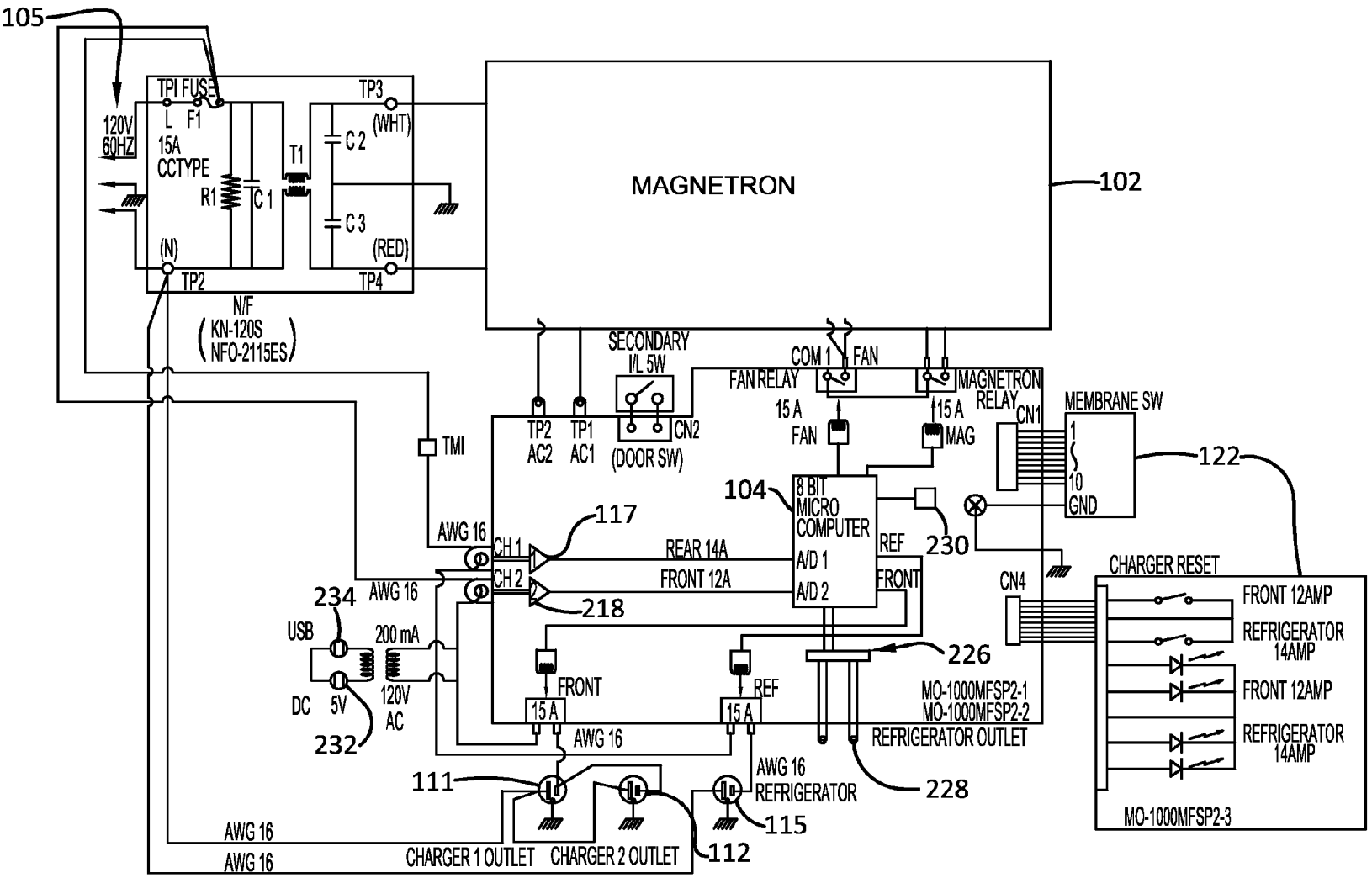
FIG. 18 is a schematic diagram of the embodiment of FIG. 17.
Figure 20:
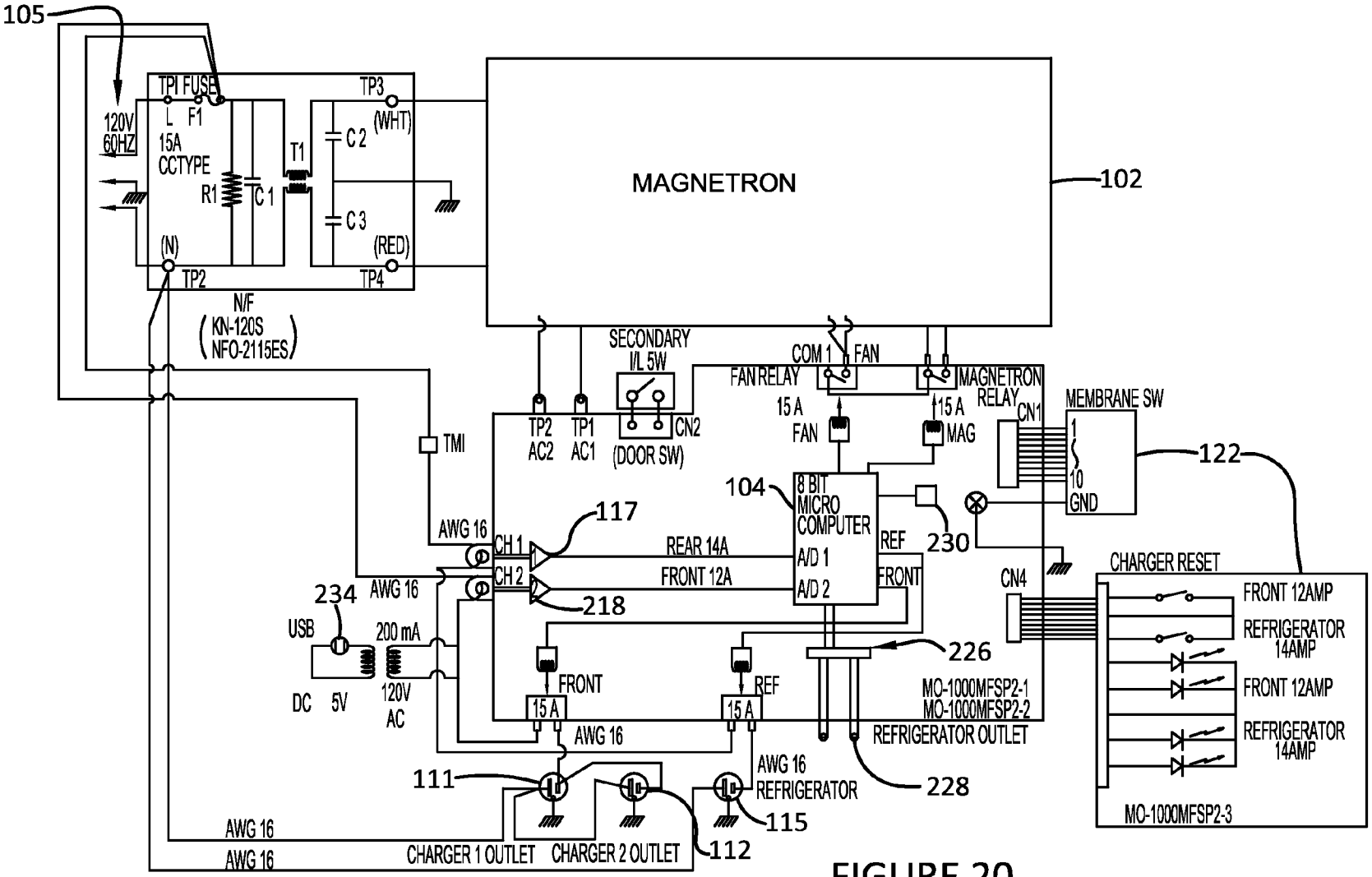
FIG. 20 is a schematic diagram of the embodiment of FIG. 19.

As seen in FIGS. 16, 18, and 20, a safety sensor 226 such as a smoke or gas sensor may be provided in the microwave oven 2. The smoke sensor 226 operates to turn off the microwave oven upon sensing smoke or polluted air indicative of a dangerous condition such as the microwave being on fire. The safety sensor 226 may be powered on when the microwave oven is in operation. The sensor 226 may be an alcohol sensor that is coupled with a thermistor 228. The alcohol sensor 226 may operate in the temperature range of 32 to 104 degrees Fahrenheit. When abnormal heating is sensed by the thermistor 228, the thermistor 228 causes the alcohol sensor 226 to turn on and check the gas.

If the alcohol sensor 226 senses polluted air that is indicative of a dangerous condition, a shutdown signal is outputted by the alcohol sensor to the microcontroller 104. Upon receiving the shutdown signal, the microcontroller 104 determines that the microwave oven 2 should be shut down and causes the microwave to shutdown. If (after the alcohol sensor is caused to be turned on by the thermistor) the alcohol sensor 226 senses air that is not indicative of a dangerous condition such as the air produced by normal cooking of food in the microwave oven 2, the alcohol sensor will not send a shutdown signal to the microcontroller 104.

Alternatively or in addition, a fault indicator 230 may be coupled to the microcontroller 104 or other circuitry to indicate that there is a dangerous condition upon detection by the alcohol sensor 226. For example, the fault indicator 230 may be a buzzer that is activated in response to the alcohol sensor 226 sensing polluted air indicative of a dangerous condition. In another example, fault indicator 230 may include the display 124 displaying a fault message such as "E-1" in response to the alcohol sensor 226 detecting polluted air indicative of a dangerous condition.

The embodiment may include a combination of fault indicators. For example, upon the alcohol sensor 226 sensing air that is indicative of a dangerous condition, a shutdown signal is outputted by the alcohol sensor 226 to the microcontroller 104. Upon receiving the shutdown signal, the microcontroller 104 determines that the microwave oven 2 should be shut down and causes the microwave oven 2 to shutdown. In addition, a buzzer is activated and the display 124 displays a fault message such as "E-1" in response to the alcohol sensor 226 sensing polluted air indicative of a dangerous condition.

The alcohol 226 sensor may be reset automatically upon the alcohol sensor 226 not detecting gas indicative of the dangerous condition. Alternatively or in addition, the alcohol sensor 226 may be reset upon opening of the microwave door 9 of the microwave oven 2. The display may display a "bar" or other suitable icon to indicate that the alcohol sensor 226 is turned on. Other types of suitable safety sensors may also be used instead of the alcohol sensor to detect a dangerous condition.

Figure 15:
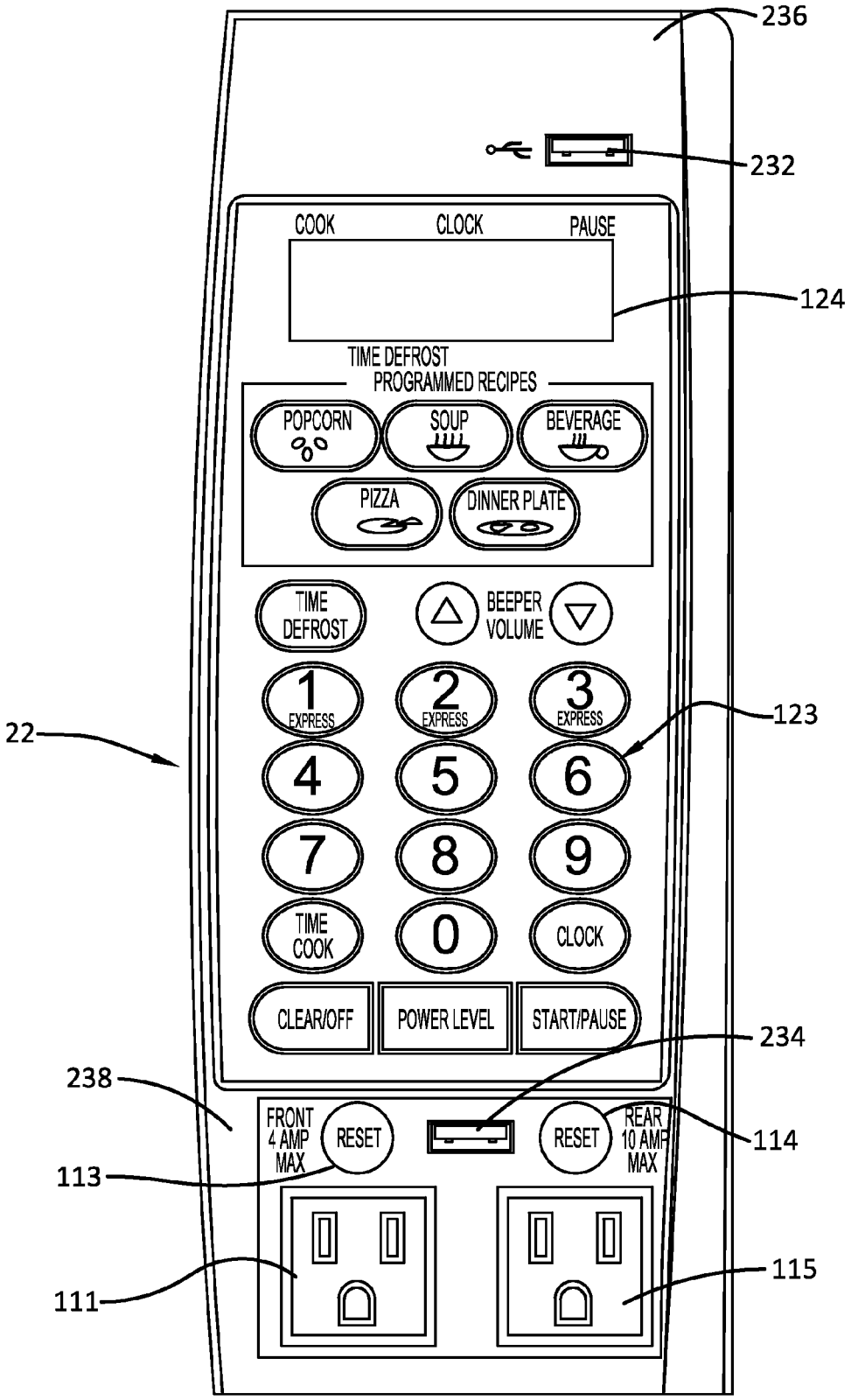
FIG. 15 is an illustration of a control panel of an alternate embodiment of this application.

As seen in FIGS. 15 and 16, the front control panel 22 of the microwave oven 2 may include Universal Serial Bus (USB) ports 232, 234 for connection, communication, and power supply between the front control panel 22 and electronic devices such as a personal computer, cell phone, iPod®, iPad®, or other suitable device to allow communication and/or charging of the electronic device plugged into the USB ports. In one exemplary embodiment, a first USB port 232 may be provided on the upper portion 236 of the front control panel 22, and a second USB port 234 may be provided on the lower portion 238 of the front control panel 22 above the auxiliary outlets 111, 112 and between the reset buttons 113, 114 as seen in FIG. 15. The first USB port 232 may include a three ampere fuse and a linear time-variant system (LVT) of 100 mA, 120 volts, and 12 watts. The second USB port 234 may include a linear time-variant system (LVT) of 200 mA, 120 volts, and 24 watts. The second USB port 234 may also be reset. The current sensor 118 may be constructed to limit the second USB port and the two auxiliary outlets to 12 amps. The USB ports 232, 234 may be in operative connection with respective printed circuit boards. Alternatively or in addition, one or more USB ports may be provided on the rear of the microwave oven, the sides of the microwave oven, and/or the top or bottom of the microwave oven. Alternatively or in addition, one or more auxiliary outlets may be provided on the rear of the microwave oven, the sides of the microwave oven, and/or the top or bottom of the microwave oven. Alternatively, the refrigerator outlet may be provided on the top, bottom, or one of the sides of the microwave oven.

Figure 17:
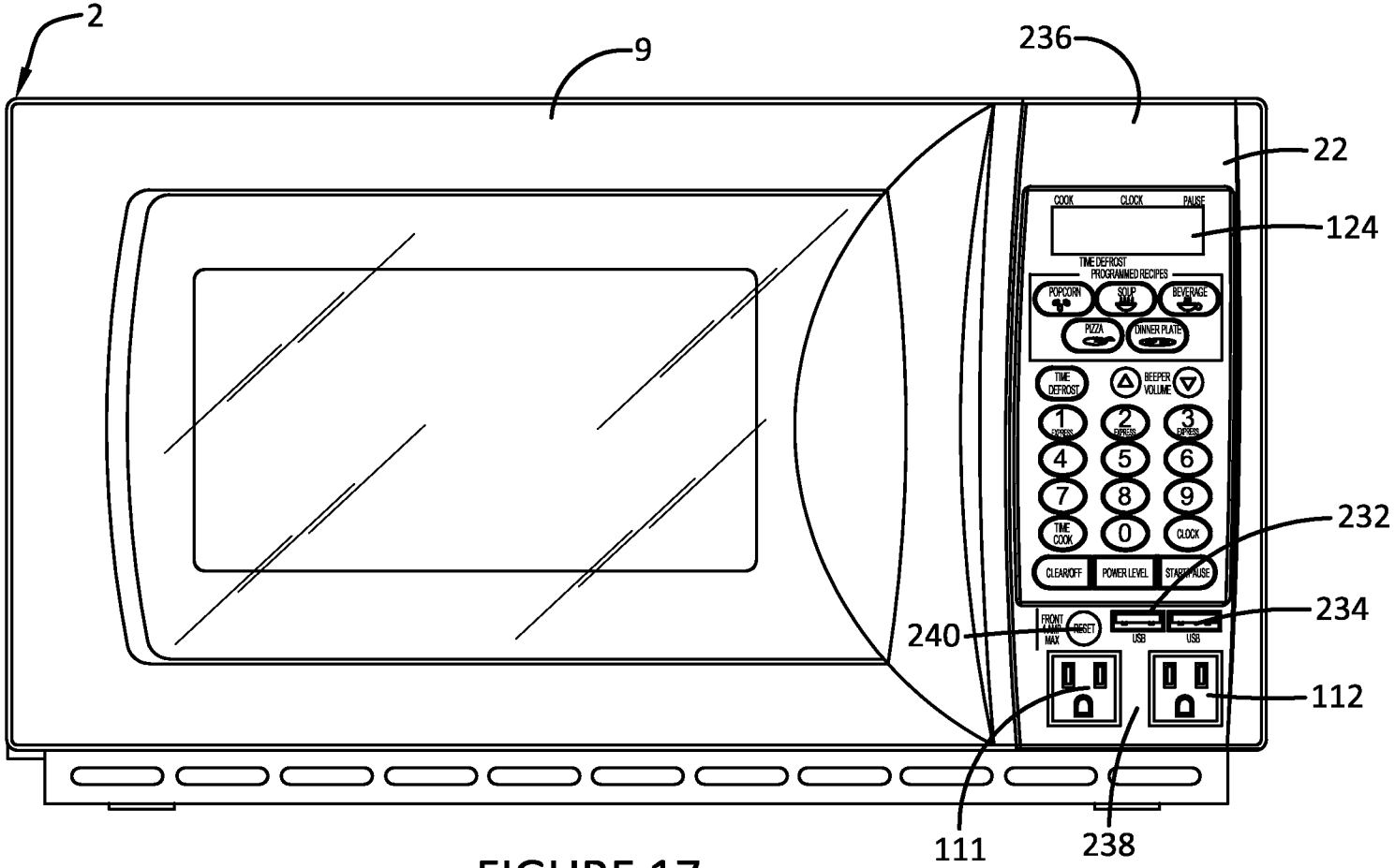
FIG. 17 is a front view of the microwave oven according to another embodiment of this application.

FIGS. 17 and 18 show another exemplary arrangement of the USB ports 232, 234. In this arrangement, the first and second USB ports 232, 234 are located side by side on the lower portion 238 of the front control panel 22 above the auxiliary outlets 111, 112. The USB ports 232, 234 are also located rightwardly (as viewed in FIG. 17) adjacent a status LED indicator and reset button 240. In this exemplary arrangement, current sensor 218 is connected to monitor the combined current in the USB ports 232, 234 and the auxiliary outlets 111 and 112. The current sensor 218 is constructed to limit the combined current in the USB ports and auxiliary outlets 111 and 112 to 12 amperes. The LED indicator and reset button 240 may light on when power to the auxiliary outlets 111, 112 and the USB ports 232, 234 is available and flash when disabled. In another embodiment, the LED indicator and reset button 240 may be off when power to the auxiliary outlets 111, 112 and the USB ports 232, 234 is available and light on or flash when disabled. Depressing the LED indicator and reset button 240 enables the auxiliary outlets 111, 112 and the USB ports 232, 234 so that power may be supplied to them when the combined current in them falls from above to below the limit.

Figure 19:
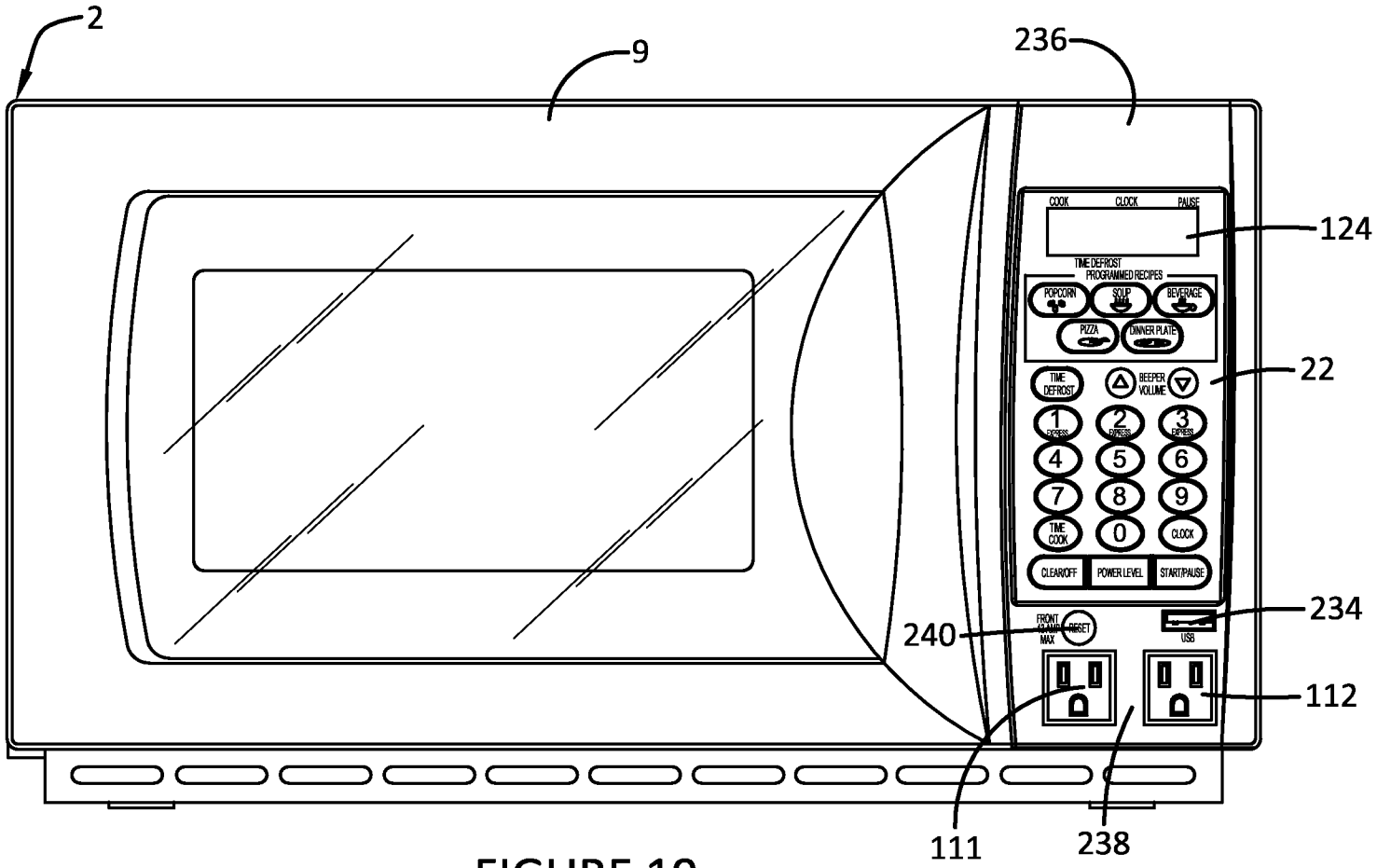
FIG. 19 is a front view of the microwave oven according to another embodiment of this application.

FIGS. 19 and 20 show an alternative arrangement in which one USB port 234 is located above the auxiliary outlets 111, 112 and rightwardly adjacent the status LED indicator and reset button 240. In this exemplary arrangement, the current sensor 218 is connected to monitor the combined current in the USB port 234 and auxiliary outlets 111 and 112. The current sensor 218 is constructed to limit the combined current in the USB port 234 and auxiliary outlets 111 and 112 to 12 amperes. Alternatively, the current sensor 218 may be constructed to limit the combined current in the USB port 234 and the auxiliary outlets 111 and 112 to 13 amperes. The LED indicator and reset button 240 may light on when power to the auxiliary outlets 111, 112 and the USB port 234 is available and flash when disabled. In another embodiment, the LED indicator and reset button 240 may be off when power to the auxiliary outlets 111, 112 and the USB port 234 is available and light on or flash when disabled. Depressing the LED indicator and reset button 240 enables the auxiliary outlets 111, 112 and the USB port 234 so that power may be supplied to them when the combined current in them falls from above to below the limit. All other elements of the embodiments of FIGS. 17-20 are similar in structure and function as the embodiment shown in FIGS. 1-11. Thus, the same reference numbers will be used in this exemplary embodiment to indicate elements that are similar in the embodiments shown in FIGS. 1-11.

Figure 21:
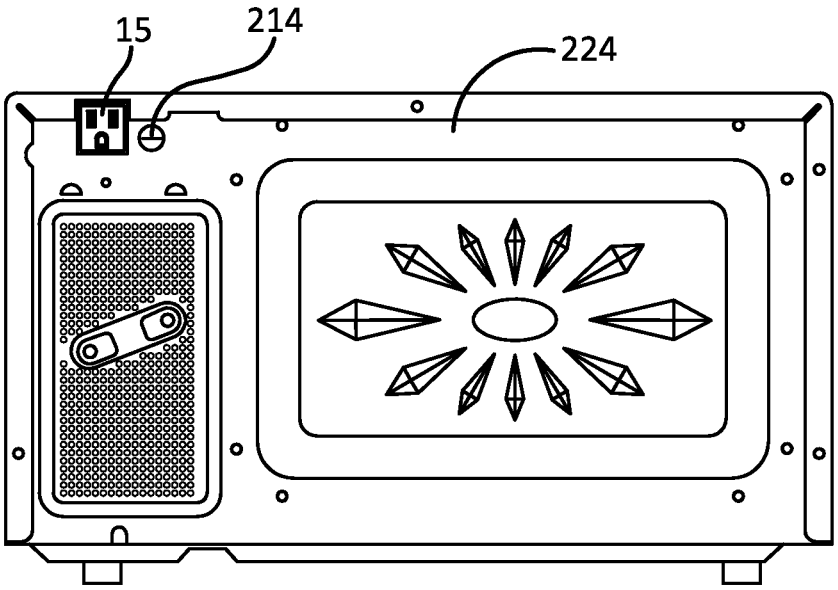
FIG. 21 is a rear view of the microwave oven according the embodiments of FIGS. 12-19.
Figure 22:
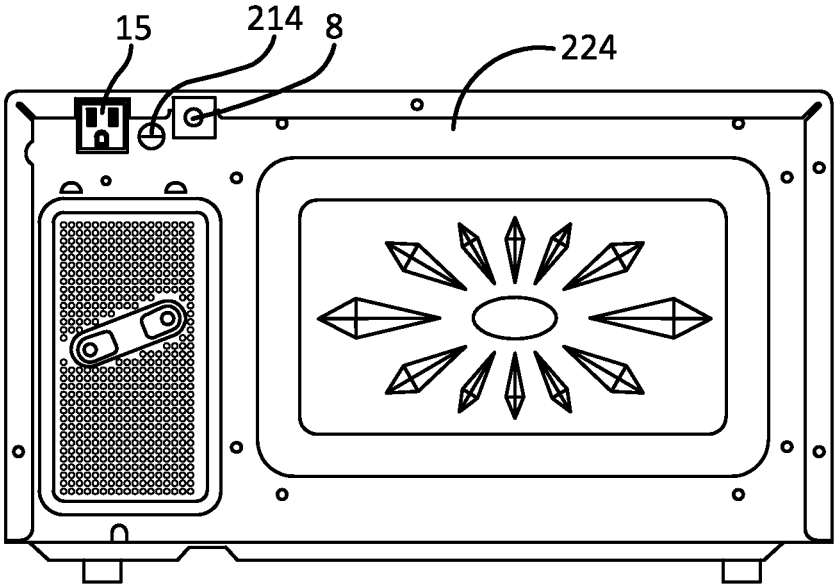
FIG. 22 is a similar view as that of FIG. 21 except that the AC cord is shown.

FIG. 21 shows the rear portion 244 of the microwave oven for the embodiments shown in FIGS. 12-20. Refrigerator outlet 15 is shown to be provided on and accessible from the rear portion 244 of the microwave oven and is associated with the LED indicator and reset button 214, which is also provided on the rear portion 244 of the microwave oven. FIG. 22 is a similar view as FIG. 21 except that AC cord 8 for the microwave oven is shown.

In the embodiments shown in FIGS. 12-22, control models may be established for execution by the controller or microprocessor 4. These models can be in the form of algorithms stored in a computer readable medium, such as software or firmware within the microprocessor 104. The models or scenarios are, in the first instance, dependent on the state of operation of the microwave oven 2. The current demands of the microwave oven 2 are generally the most significant contribution to overload. To avoid overload conditions, power to the low power receptacles or auxiliary outlets, refrigerator receptacle, and/or USB ports is disabled during microwave operation.

Figure 23:
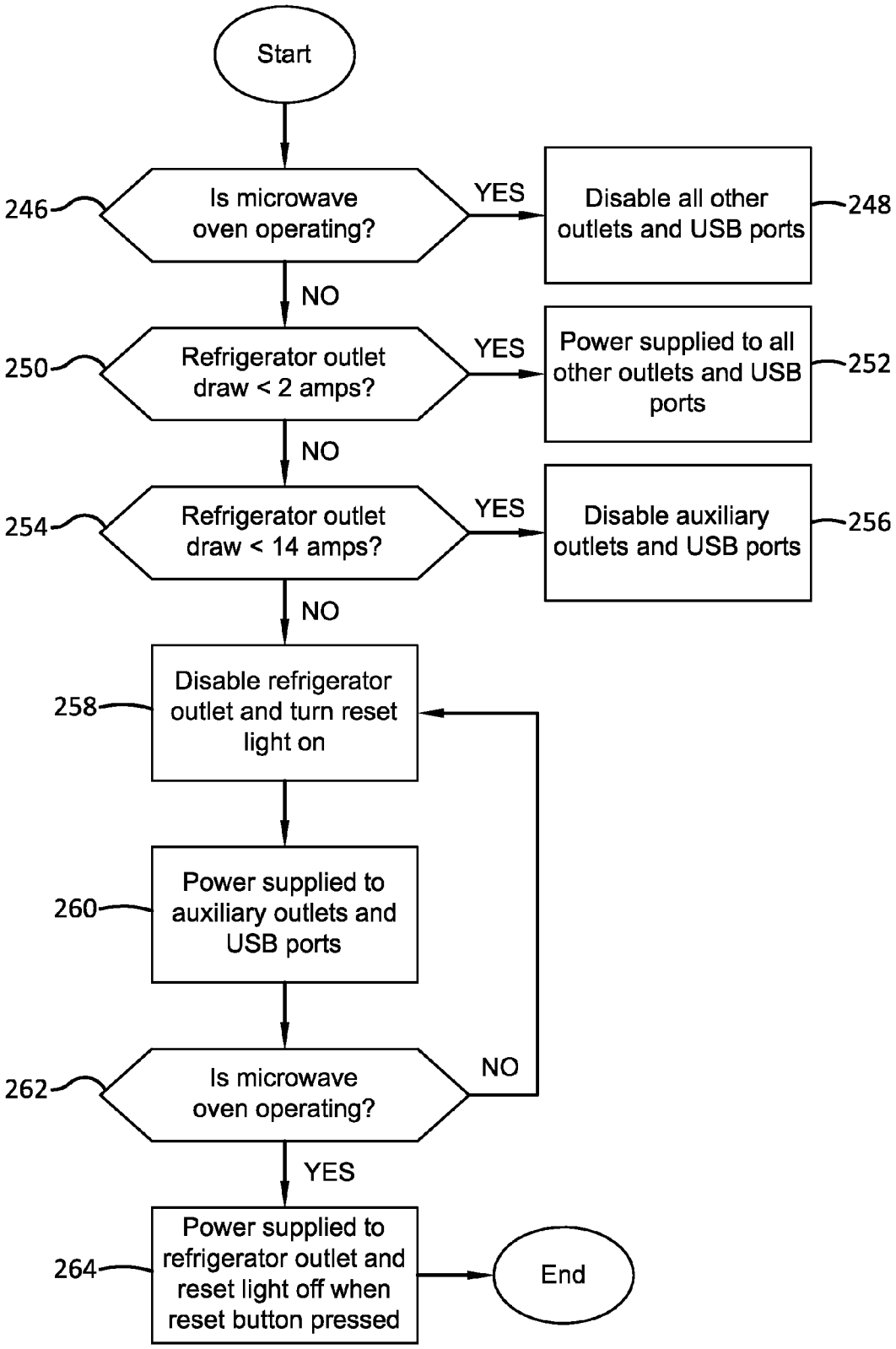
FIG. 23 is a flow diagram of an embodiment of this application.

FIG. 23 shows a flow chart illustrating several control models or scenarios. The microprocessor 104 begins by determining whether the microwave oven is turned on or operating in step 246. When the microwave oven is turned on or operating, the rear refrigerator outlet 15, the two auxiliary outlets 111, 112 on the front control panel 22, and the two USB ports 232, 234 on the front control panel are all turned off or disabled, so that the total draw of current for the combination microwave and refrigerator is not over 15 amperes as indicated in step 248.

When the microwave oven is not operating and items are plugged into the two USB ports 232, 234, two auxiliary outlets 111, 112, and rear refrigerator outlet 15, then the microprocessor 104 determines whether the refrigerator outlet 15 is drawing less than 2 amperes (approximately the average amperes when the refrigerator is running) in step 250. If the refrigerator outlet 15 is drawing less than 2 amperes, then all the outlets 15, 111, 112 and USB ports 232, 234 are enabled, so that power may be supplied to them as indicated in step 252. If the refrigerator outlet 15 not drawing less than 2 amperes, the microprocessor 104 determines whether the refrigerator outlet 15 is drawing less than 14 amperes in step 254. If the refrigerator outlet 15 is drawing less than 14 amperes but not less than or greater than or equal to 2 amperes, then the auxiliary outlets 111, 112 and USB ports 232, 234 are disabled or turned off so that no power may be supplied to them as indicated in step 256. The refrigerator outlet 15 remains enable. If the refrigerator outlet 15 is not drawing less than 14 amperes or drawing greater than or equal to 14 amperes, then the refrigerator outlet 15 is disabled in step 258. This may be accomplished by tripping the relay 20 of the reset circuit off. In addition, the red LED light on the LED indicator and reset button 214 is turned on to identify the disablement condition of the refrigerator. Then, in step 260, the auxiliary outlets 111, 112 and USB ports 232, 234 are enabled so that power may be supplied to them.

Then, the microprocessor determines whether the refrigerator outlet 15 is drawing less than 14 amperes in step 262. If the refrigerator outlet 15 is not drawing less than 14 amperes or drawing greater than or equal to 14 amperes, then the refrigerator outlet 15 remains disabled and the red LED light on the LED indicator and reset button 214 remains turned on to identify the disablement condition of the refrigerator 3. This condition may occur, for example, if an electrical heater is plugged into the refrigerator outlet 15. When the refrigerator outlet 15 draws less than 14 amperes resulting from the overload condition being eliminated, the refrigerator outlet 15 will be enabled so that power may supplied to the refrigerator outlet 15 upon the LED indicator and reset button 214 being depressed as indicated in step 264. Depression of the LED indicator and reset button 214 in this condition will also turn off the red LED light. The process then ends. It should be noted that the microprocessor 104 can make the determination in steps at the same time or in a different order.

It should be understood that the above description is only illustrative of the invention. Various alternatives and modifications can be devised by those skilled in the art without departing from the invention. Accordingly, the present invention is intended to embrace all such alternatives, modifications and variances which fall with the scope of the appended claims.

What is claimed is:

1. A system of linked appliances comprising:

a microwave oven connected to a source of power and having a control circuit for controlling the operation of the microwave oven;

a first power supply outlet provided on the microwave oven;

a refrigerator connected to the source of power by connection to the first power supply outlet;

a second power supply outlet connected to the source of power through the control circuit, the second power supply outlet adapted to be electrically connected to at least one device having lower power consumption requirements than power requirements of the refrigerator;

sensing components connected to sense current draw at the second power supply outlet, and generating signals indicative thereof;

wherein the control circuit is configured to enable or disable power to the microwave oven, the first power supply outlet and the second power supply outlet, and wherein the control circuit:

disables the refrigerator and the second power supply outlet, when the microwave oven draws cooking power; and enables the second power supply outlet when the microwave oven does not draw cooking power; and wherein the microwave oven includes a front portion, wherein the front portion includes a door and a front control panel, wherein the front control panel includes the second power supply outlet, wherein the second power supply outlet includes at least one USB port which is not electrically powered and inoperative when the microwave oven draws cooking power.

2. The system according to claim 1 wherein the control circuit further disables the second power supply outlet when signals generated by the sensing components indicate current draw at the second power supply outlet in excess of a predetermined limit.

3. The system according to claim 2, and further comprising a visible indicator on the front control panel, wherein the visible indicator changes visible condition responsive to the second power supply outlet being electrically disabled or enabled.

4. The system according to claim 3 and further comprising a manual input device on the front control panel, wherein the control circuit causes the second power supply outlet to remain disabled after the predetermined limit is exceeded, until at least one input is received through the manual input device.

5. The system according to claim 1, wherein the control circuit starts a timer clock when the refrigerator is disabled and prevents the subsequent enabling of the refrigerator before the expiration of a predetermined time limit.

6. The system according to claim 5, wherein the predetermined time period is three minutes.

7. The system according to claim 1, wherein the second power supply outlet includes at least two USB ports configured when electrically enabled to provide power to charge battery operated electronic devices, and wherein the sensing components are operative to sense the current demanded at each of the USB ports.

8. The system according to claim 1, wherein the sensing components further include a first current sensor operative to monitor current draw on the first power supply outlet, and a second current sensor operative to monitor current draw on the second power supply outlet, wherein the control circuit, responsive to the first and second current sensors is configured to make a determination that total combined current draw on the first and second power supply outlets exceeds a predetermined value, wherein the control circuit is operative to disable power to the first and second power supply outlets responsive to the determination.

9. The system according to claim 8 wherein the front control panel includes a first reset input device and a second reset input device, wherein the control circuit is operative to restore electrical power to the disabled first power supply outlet responsive to an input to the first reset input device, and to the disabled second power supply outlet responsive to another input to the second input device.

10. The system according to claim 9 wherein the front control panel includes a first visual indicator associated with the first power supply outlet and a second visual indicator associated with the second power supply outlet, wherein the first visual indicator gives a visual indication when the first power supply outlet is disabled and the second visual indicator gives the visual indication when the second power supply outlet is disabled.

11. The system according to claim 1, wherein the second power supply outlet comprises at least one AC outlet and the at least one USB port;

wherein the sensing components further include a first current sensor operative to monitor current draw on the first power supply outlet and a second current sensor operative to monitor total combined current draw on the at least one AC outlet and the at least one USB port, wherein the control circuit is configured to limit the total combined current draw on the at least one AC outlet and the at least one USB port to no more than a predetermined value.

12. A system of linked appliances comprising:

a microwave oven connected to a source of power and having a control circuit for controlling the operation of the microwave oven;

a first power supply outlet provided on the microwave oven;

a refrigerator connected to the source of power by connection to the first power supply outlet;

a second power supply outlet connected to the source of power through the control circuit, the second power supply outlet adapted to be electrically connected to at least one device having lower power requirements than power requirements of the refrigerator;

sensors connected to sense current demanded at the second power supply outlet, and generating signals indicative thereof;

wherein the control circuit is configured to enable or disable power to the microwave oven, the first power supply outlet and the second power supply outlet, and wherein the control circuit:

disables the refrigerator and the second power supply outlet, when the microwave oven draws cooking power; and enables the second power supply outlet when the microwave oven does not draw cooking power; and wherein the microwave oven includes a front portion and a rear portion, wherein the front portion includes the second power supply outlet, wherein the second power supply outlet includes a USB port that is not operative when the microwave oven draws cooking power, and wherein the rear portion includes the first power supply outlet.

13. The system according to claim 12 wherein the control circuit further disables the second power supply outlet when the signals indicate current through the second power supply outlet exceeds a predetermined limit.

14. The system according to claim 13 wherein the second power supply outlet includes at least one AC outlet and at least one USB port.

15. The system according to claim 13 wherein the front portion includes at least one visual indicator and at least one input device, wherein the at least one visual indicator visually indicates when the second power supply outlet is enabled or disabled, and the control circuit is operative to reinstate power to the disabled second power supply outlet responsive to an input to the at least one input device.

16. The system according to claim 15, wherein the control circuit is operative to disable the first and second power supply outlets when total cumulative power through the first and second power supply outlets exceeds a limit, wherein the front portion includes a further visual indicator operative to indicate that the first power supply outlet is disabled, and a further input device, wherein a further manual input to the further input device is operative to cause the control circuit to restore power to the disabled first power supply outlet.

17. A system of linked appliances comprising:

a microwave oven connected to a source of power and having a control circuit operative to control the operation of the microwave oven;

a first power supply outlet operatively connected to the source of power through operation of the control circuit;

a refrigerator connected to the source of power by connection to the first power supply outlet;

a second power supply outlet operatively connected to the source of power through operation of the control circuit, wherein the second power supply outlet includes at least one USB port;

sensing components connected to sense current demanded at the second power supply outlet, and generating signals indicative thereof;

wherein the control circuit is configured to enable or disable power to the microwave oven, the first power supply outlet and the second power supply outlet, and wherein the control circuit:

disables the refrigerator and the second power supply outlet including the at least one USB port, when the microwave oven draws cooking power; and wherein the control circuit is configured to disable the second power supply outlet including the at least one USB port, when the refrigerator is operated during refrigerator compressor startup.

18. The system according to claim 17, wherein the first power supply outlet extends on a rear face of the microwave oven and the second power supply outlet extends on a front face of the microwave oven, wherein the second power supply outlet includes at least one AC outlet and the at least one USB port.

19. The system according to claim 18, wherein the control circuit is operative to cause power to be withdrawn from the at least one AC outlet and the at least one USB port responsive to total cumulative power draw therethrough exceeding a threshold, independent of power draw through the first power supply outlet.

20. The system according to claim 19, wherein the control circuit is operative to cause power to be withdrawn from all of the first power supply outlet, the at least one USB port and the at least one AC outlet, responsive to total cumulative power draw through all of such first power supply outlet, at least one USB port and at least one AC outlet, exceeding a further threshold.

21. The system according to claim 20, wherein the front face includes a first visual indicator operative to visually indicate that power has been withdrawn from the first power supply outlet, and a second visual indicator operative to visually indicate that power has been withdrawn from at least one of the at least one USB port and the at least one AC outlet.

22. The system according to claim 21 wherein the front face includes a first reset input device and a second reset input device, wherein manual input to the first reset input device is operative to cause the control circuit to cause delivery of electrical power to the first power supply outlet when such first power supply outlet is currently disabled, wherein manual input to the second reset input device is operative to cause the control circuit to cause delivery of electrical power to at least one of the at least one AC outlet and the at least one USB port, when such at least one AC outlet and USB port are currently disabled.

* * * * *